US006253511B1

(12) United States Patent
Boyer

(10) Patent No.: US 6,253,511 B1
(45) Date of Patent: Jul. 3, 2001

(54) COMPOSITE JOINERY

(75) Inventor: Keith Boyer, Moon Township, PA (US)

(73) Assignee: Centria, Moon Township, PA (US)

( * ) Notice: Subject to any disclaimer, the term of this patent is extended or adjusted under 35 U.S.C. 154(b) by 0 days.

(21) Appl. No.: 09/196,050

(22) Filed: Nov. 19, 1998

(51) Int. Cl.[7] ..... E04B 2/92

(52) U.S. Cl. ..... 52/302.4; 52/235; 52/533; 52/539

(58) Field of Search ..... 52/523, 524, 525, 52/533, 539, 541, 235, 302.1, 302.6, 302.3, 302.4

(56) References Cited

U.S. PATENT DOCUMENTS

| | | | |
|---|---|---|---|
| 3,120,082 | | 2/1964 | Mendelsohn . |
| 3,158,960 | | 12/1964 | Newton et al. . |
| 3,246,436 | | 4/1966 | Roush . |
| 3,740,909 | | 6/1973 | Stinnes . |
| 3,797,190 | | 3/1974 | Widdowson . |
| 4,114,335 | | 9/1978 | Carroll . |
| 4,123,885 | | 11/1978 | Scott . |
| 4,184,301 | | 1/1980 | Anderson et al. . |
| 4,320,613 | | 3/1982 | Kaufman . |
| 4,685,263 | * | 8/1987 | Ting ..... 52/235 |
| 4,751,125 | | 6/1988 | Ofterdinger . |
| 5,425,210 | | 6/1995 | Zafir . |
| 5,749,282 | | 5/1998 | Brow et al. . |
| 5,916,100 | * | 6/1999 | Mitchell et al. ..... 52/235 |

FOREIGN PATENT DOCUMENTS

| | | |
|---|---|---|
| 92 05 931 U | 8/1992 | (DE) . |
| 0 110 265 | 6/1984 | (EP) . |
| 2 262 791 | 6/1993 | (GB) . |

* cited by examiner

*Primary Examiner*—Michael Safavi
(74) *Attorney, Agent, or Firm*—Reed Smith LLP

(57) ABSTRACT

A horizontal joint between upper and lower building panels, as well as a building wall including such a horizontal joint, in which a liquid diverting arrangement includes a gutter with first and second ends and at least one aperture disposed between these ends. Also contemplated are a method and apparatus for forming at least two building panels, in which the panels have different reveal dimensions, and a method and apparatus for forming a building panel in which a first reveal portion is registered while a second reveal portion has been formed at a preselected distance therefrom. Further contemplated are a method and kit for customizably assembling a building wall, in which panels having different thickness dimensions can be interchangeably connected with one another, as well as a method and kit for customizably assembling a building wall, in which on or more decorative profile panels and one or more structural building wall panels can be interchangeably connected with one another.

26 Claims, 18 Drawing Sheets

COMPOSITE JOINERY

FIELD OF THE INVENTION

The present invention relates generally to joint arrangements and, more particularly, to composite, external panel joints for buildings.

BACKGROUND OF THE INVENTION

Generally, at a typical horizontal or vertical joint, two panels meet. Each panel typically includes one or more liners that encase a homogenous core, such as a foam core. It is also known to provide each panel with one or more "male" or "female" connecting portions, each configured to accommodate respective "female" or "male" connecting portions of the other panel.

In the context of horizontal joints, an internal gutter may be included in order to accommodate liquid that has bypassed the joint. One way to drain the liquid is via the provision of vertical channels between horizontally adjacent panels. Such gutters also often typically serve as effective media for equalizing pressure within the horizontal joint in question. U.S. Pat. No. 5,749,282, to Brow et al. discloses a conventional horizontal joint having these features.

U.S. Pat. No. 3,740,909 (Stinnes), appears to disclose an arrangement for affording drainage from a panel. Particularly, Stinnes shows an arrangement of grooves 45 (see FIG. 5) that appear to attend to the problem of internal drainage. However, a highly complicated structure is provided, with a highly unique application.

In the context of horizontal joints between vertically adjacent horizontal panels, a need has thus been recognized in connection with providing effective and efficient drainage from an internal gutter, while avoiding the use of complicated and potentially costly structures for that purpose.

An independent need has also been recognized in the context of both horizontal and vertical joints, in connection with providing a reveal that is deeper than the norm, both for aesthetic purposes and, in at least some instances, easier installation.

Further, a need has also been recognized in connection with facilitating the customizable manufacture of horizontal or vertical panels with reveals.

Finally, but not necessarily exclusively, a need has also been recognized in connection with affording the facilitated customization of building wall assemblies, having horizontal and/or vertical panels, in which an insulative panel, such as one including structural foam, can easily be juxtaposed with simple profile panels (e.g., formed from sheet metal) in a desired predetermined arrangement.

SUMMARY OF THE INVENTION

The present invention contemplates, in accordance with at least one presently preferred embodiment, an arrangement in which at least one aperture is provided over a predetermined horizontal extent of an internal gutter of a horizontal joint. Thus, any liquid collected in the internal gutter may drain outwardly through the aperture(s) in the gutter, rather than, or in addition to, being fed to vertical channels.

The present invention also contemplates, in accordance with at least one presently preferred embodiment, a reveal (i.e., an inward recess into at least one of the upper and lower panels) that is considerably deeper than the norm, conceivably two or three times as deep. The advantages include eased bending in corner panels and the fact that unsightly repairs can be concealed in the back of the reveal. If one or more apertures, as described above, is provided, such a deep reveal can provide for an easy drainage path for liquid exiting the aperture(s). A sloped drainage shelf may be provided as part of the reveal, in order to assist drainage.

Further, another concept contemplated by at least one presently preferred embodiment of the present invention is the customization of horizontal joints to have any of a variety of reveal sizes or types. For example, the reveal can be changed in size so that, for example, reveal sizes from ⅛" to 2" are attainable in ¼" increments.

Another concept contemplated by at least one presently preferred embodiment of the present invention is the selective, customizable juxtaposition of insulative panels, such as those including structural foam, with simple profile panels in a desired predetermined arrangement. Unique connective media are preferably provided for this purpose.

Generally, at least one presently preferred embodiment of the present invention broadly contemplates a horizontal joint between upper and lower building panels, wherein: the lower panel comprises at least one connector comprising at least one of: at least one male connector and at least one female connector; the upper panel comprises at least one connector comprising at least one of: at least one male connector and at least one female connector; at least one connector of the upper panel being connected with at least one connector of the lower panel to form an outer joint; an arrangement for diverting liquid; the liquid diverting arrangement comprising a gutter; the gutter having first and second ends; the liquid diverting arrangement further comprising at least one aperture disposed between the first and second ends of the gutter.

Further, at least one presently preferred embodiment of the present invention broadly contemplates a building wall comprising: an upper building panel and a lower building panel; the lower panel comprises at least one connector comprising at least one of: at least one male connector and at least one female connector; the upper panel comprises at least one connector comprising at least one of: at least one male connector and at least one female connector; at least one connector of the upper panel being connected with at least one connector of the lower panel to form an outer joint; an arrangement for diverting liquid; the liquid diverting arrangement comprising a gutter; the gutter having first and second ends; the liquid diverting arrangement further comprising at least one aperture disposed between the first and second ends of the gutter.

Additionally, at least one presently preferred embodiment of the present invention broadly contemplates joint between two building panels, comprising a reveal having a depth that is no less than about 0.75 inch.

Further, at least one presently preferred embodiment of the present invention broadly contemplates a method of forming at least two building panels, the method comprising the steps of: providing apparatus for forming building panels; forming a first panel with the apparatus; forming a second panel with the apparatus; the forming of the first panel comprising the formation of at least a portion of a first reveal; and the forming of the second panel comprising the formation of at least a portion of a second reveal; wherein the first and second reveals comprise different dimensions.

Moreover, at least one presently preferred embodiment of the present invention broadly contemplates apparatus for forming at least two building panels, the apparatus comprising: an arrangement for forming first and second panels; the panel forming arrangement comprising an arrangement for forming at least a portion of a first reveal in the first panel and at least a portion of a second reveal in the second panel; the reveal forming arrangement comprising an arrangement for imparting different dimensions to the first and second reveals.

Furthermore, at least one presently preferred embodiment of the present invention broadly contemplates a method of forming a building panel, the method comprising the steps of: forming a first portion of a reveal in the building panel; forming a second portion of the reveal at a preselectably variable distance with respect to the first portion; and thereafter registering the first portion of the reveal.

Additionally, at least one presently preferred embodiment of the present invention broadly contemplates apparatus for forming a building panel, the apparatus comprising: an arrangement for forming a first portion of a reveal in the building panel; an arrangement forming a second portion of the reveal at a preselectably variable distance with respect to the first portion; and an arrangement for registering the first portion of the reveal.

Further, at least one presently preferred embodiment of the present invention broadly contemplates method of customizably assembling a building wall, the method comprising the steps of: providing at least one panel having a first thickness dimension; providing at least one panel having a second thickness dimension, the second dimension being different from the first dimension; and effecting at least one connection between a panel having the first thickness dimension and a panel having the second thickness dimension; wherein at least one of: a panel having the first thickness dimension and a panel having the second thickness dimension comprises an arrangement for interchangeably connecting with a panel having the first thickness dimension and a panel having the second thickness dimension.

Additionally, at least one presently preferred embodiment of the present invention broadly contemplates a kit for customizably assembling a building wall, the kit comprising: at least one panel having a first thickness dimension; and at least one panel having a second thickness dimension, the second dimension being different from the first dimension; wherein at least one of: a panel having the first thickness dimension and a panel having the second thickness dimension comprises an arrangement for interchangeably connecting with a panel having the first thickness dimension and a panel having the second thickness dimension.

Further, at least one presently preferred embodiment of the present invention broadly contemplates a method of customizably assembling a building wall, the method comprising the steps of: providing at least one panel of a first type; providing at least one panel of a second type; effecting at least one connection between a panel of the first type and a panel of the second type; the at least one panel of the first type comprising a structural building wall panel; the at least one panel of the second type comprising a decorative profile panel; at least one of: the building wall panel and the decorative profile panel comprising an arrangement for interchangeably connecting with a panel of the first type and a panel of the second type.

Finally, but not necessarily exclusively, at least one presently preferred embodiment of the present invention broadly contemplates a kit for customizably assembling a building wall, the kit comprising: at least one panel of a first type; at least one panel of a second type; the at least one panel of the first type comprising a structural building wall panel; the at least one panel of the second type comprising a decorative profile panel; at least one of: the building wall panel and the decorative profile panel comprising an arrangement for interchangeably connecting with a panel of the first type and a panel of the second type.

DESCRIPTION OF THE PRESENTLY PREFERRED EMBODIMENTS

Figure 1:
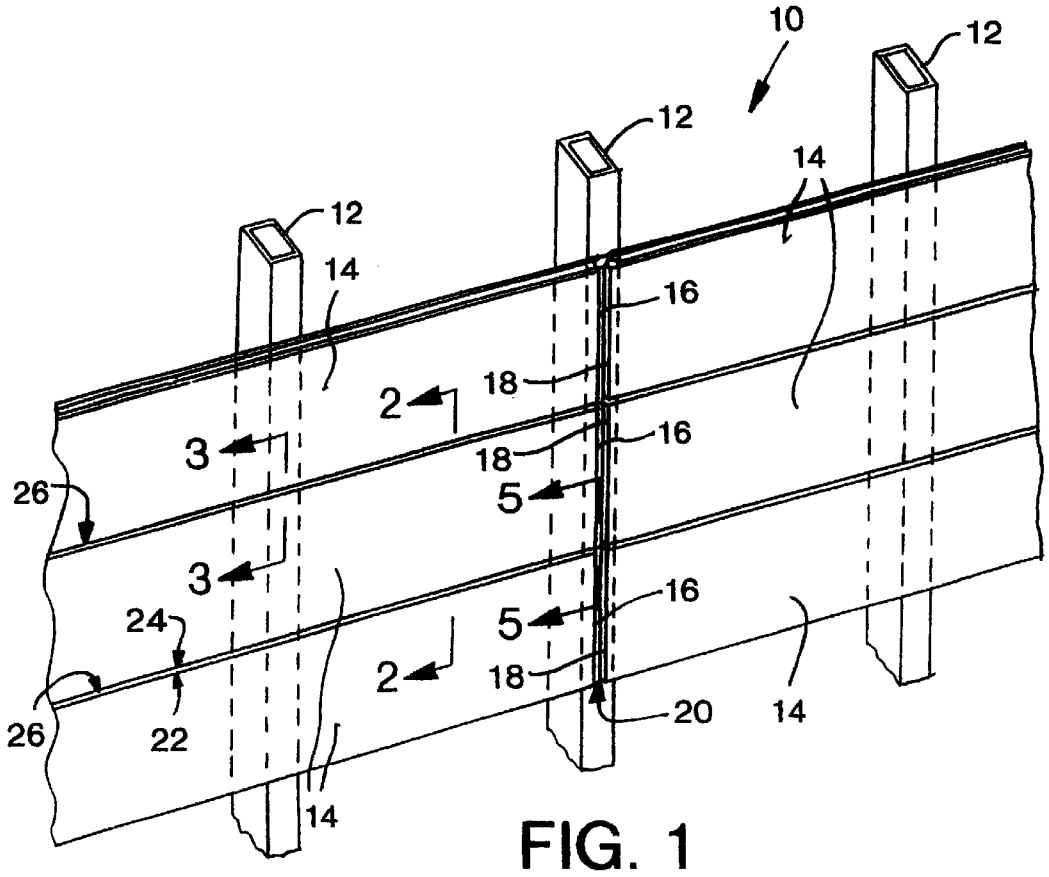
FIG. 1 is a fragmentary isometric view illustrating an exterior wall structure in a conventional horizontal panel application.
Figure 2:
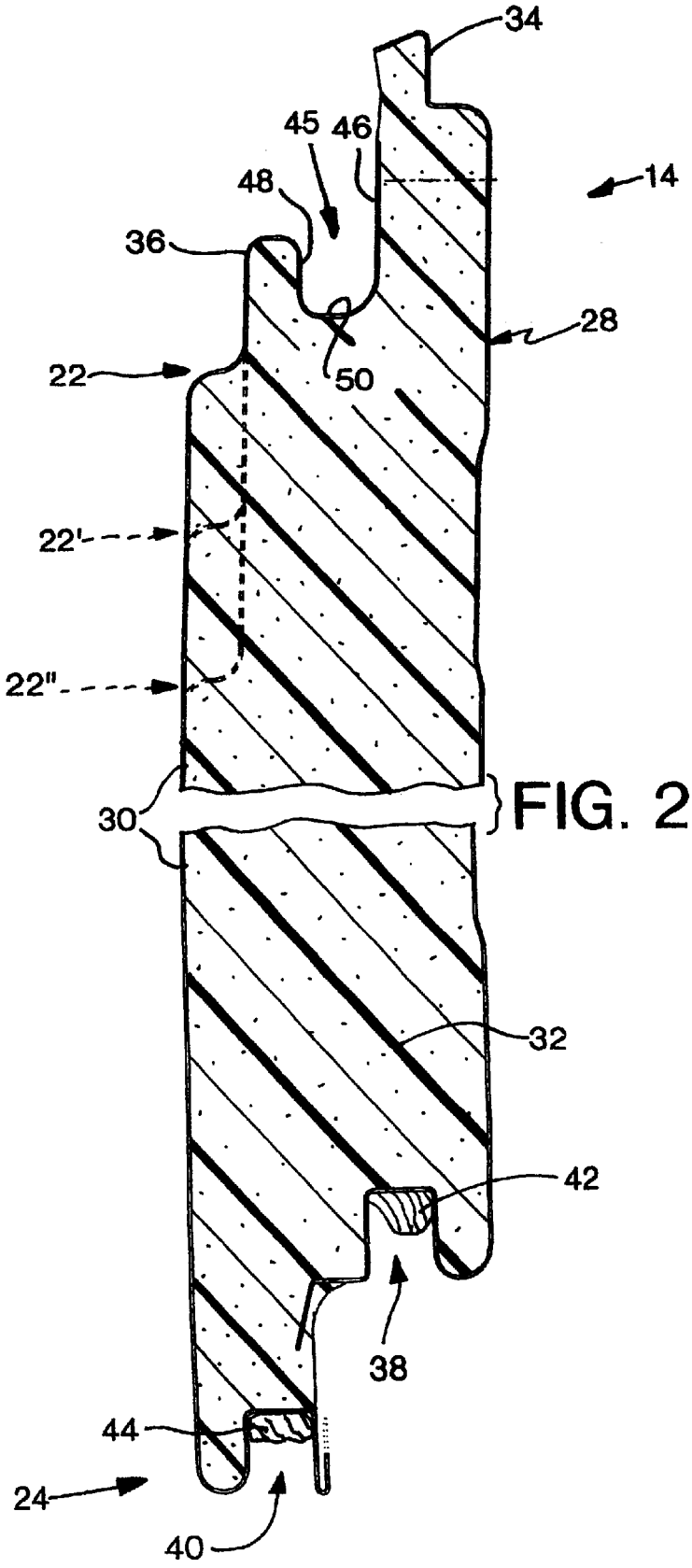
FIG. 2 is a broken cross-sectional view, taken along the line 2—2 of FIG. 1, illustrating a conventional insulated building panel.
Figure 3:
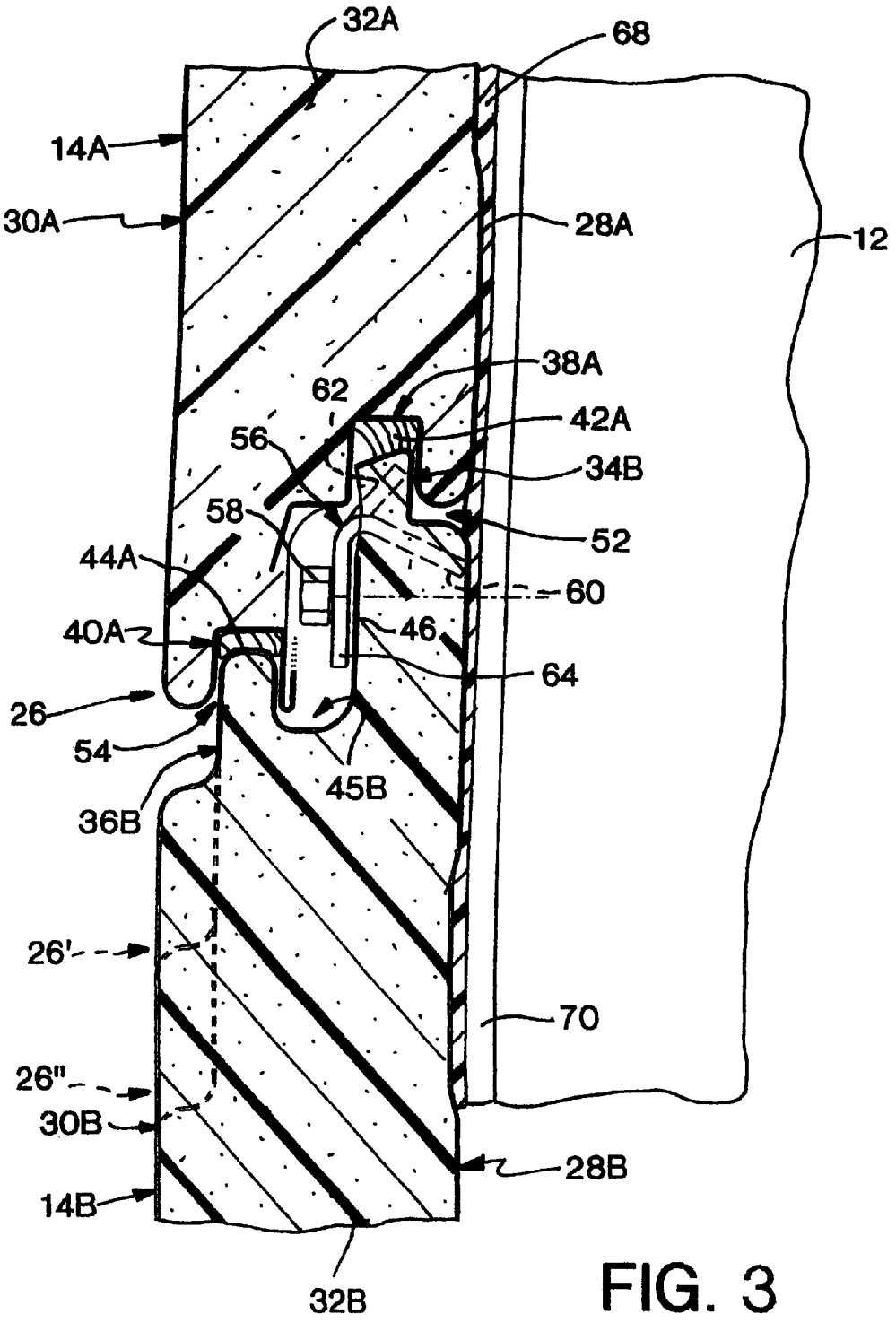
FIG. 3 is a cross-sectional view, taken along the line 3—3 of FIG. 1, illustrating a conventional horizontal joint.

FIGS. 1–3, and the accompanying disclosure herebelow, are taken from U.S. Pat. No. 5,749,282 (Brow et al.) for the purpose of illustrating conventional horizontal joinery, and associated components, having aspects that might be utilized in accordance with at least one presently preferred embodiment of the present invention. The same patent is fully incorporated by reference into this specification, in order that further conventional details forming the background and/or environment of at least one presently preferred embodiment of the present invention may be relied upon as needed.

Referring to FIG. 1, there is illustrated an exterior wall structure 10 supported on a structural framework including vertical columns 12. The wall structure 10 is assembled from individual panels 14 having adjacent panel ends 16, 18 forming a vertical joint 20 and being connected along the lower and upper side edges 22, 24 to form horizontal wall joint 26.

Referring to FIG. 2, the insulated building panel 14 comprises inner and outer facing sheets 28, 30 and a structural foam core 32 filling the interior space of the building panel 14 and adhesively connecting the facing sheets 28, 30 to provide a structural panel. At the upper edge 22 of the building panel 14, the inner and outer facing sheets 28, 30 provide inner and outer male connectors or tongues 34, 36. At the lower edge 24 of the panel 14, the inner and outer facing sheets 28, 30 provide inner and outer female connectors 38, 40 adapted to receive the tongues 34, 36 of a subjacent building panel. As is illustrated FIG. 3, the inner and outer female connectors 38, 40 each receive a bead 42, 44 of sealant, such as a non-hardening butyl sealant. The beads 42, 44 of sealant are adapted to be penetrated by the tongues 34, 36 of a subjacent panel to form inner and outer seals as shown in FIG. 3.

In accordance with the present invention, gutter means 45 is provided at the upper edge 22 of the building panel 14 and intermediate of the inner and outer tongues 34, 36. The gutter means extends substantially entirely along the full length of the building panel 14. As will be described, the gutter means serves to eliminate liquids bypassing the outer joint formed between the female connector 40 and the tongue of 36 of a subjacent building panels. The gutter means 45 has a generally U-shaped transverse profile including upstanding sides 46, 48 and a web of 50 connecting the sides 46, 48. As can be seen in FIG. 2, the side 48 of the gutter means 45 also constitutes a portion of the tongue 36. Therefore, the gutter means 45 is formed, in part, by the outer male connector tongue 36.

Figure 4:
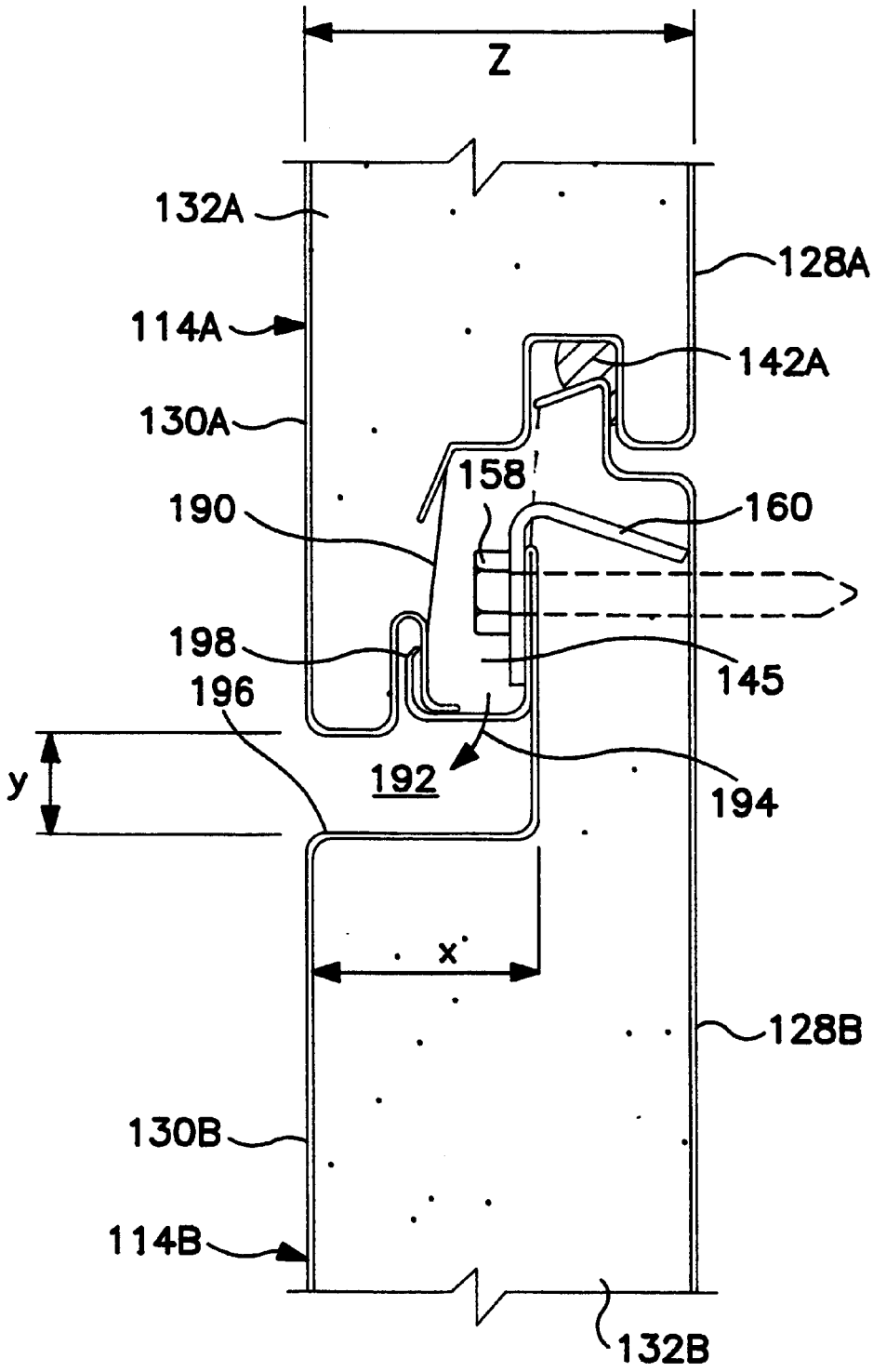
FIG. 4 is a cross-sectional view illustrating an insulated building panel according to the present invention.

Referring to FIG. 3, there is illustrated a horizontal joint 26 between upper and lower panels 14A, 14B. Comparing FIGS. 2 and 3, it will be observed that the location of the upper edge 22 may be varied, as shown at 22' and 22", and thus the width of the horizontal joint 26 may be varied as shown at 26' and 26". As can be seen in FIGS. 3 and 4, the lower building panel 14 is secured to the column 12 by a clip 56 and a fastener 58. As can be seen in FIG. 3, the clip includes a downturned central flange at 60 penetrating the foam core 32B and engaging the inner facing sheet 28B and a pair of inclined flanges 62, only one visible in FIG. 3, penetrating the foam core 32B and extending into the tongue 34B. The clip 56 also has a main flange portion 64 which overlies the upstanding side 46 of the outer facing sheet 30B. The fastener 58 extends through the main flange portion 64, the upstanding side 46, the foam core 32B, the inner facing sheets 28B and into the vertical column 12. In this manner, both the inner and outer facing sheets 28B, 30B of the panel 14B are secured to the vertical column 12.

The disclosure now turns to a discussion of various embodiments of the present invention. In FIGS. 4–7, components that are substantially analogous to components in FIGS. 1–3 have been so indicated by advancing the reference numerals by 100.

FIG. 4 is a cross-sectional view illustrating an insulated building panel according to at least one presently preferred embodiment of the present invention. In addition to the conventional components illustrated in FIGS. 1–3 (whose reference numerals have been advanced here by 100), also illustrated are thermal break 190, reveal 192, aperture(s) (or weep hole[s]) 194, sloped shelf 196 and edge-hook connection 198.

Thermal break 190, indicated with dotted lines at upper panel 114A, merely constitutes a gap between outer face sheet 130A (often termed simply a "face sheet") and inner face sheet 128A (often termed a "liner" or "liner sheet"), wherein a portion of the foam core 132A is exposed. A similar thermal break exists on lower panel 114B, not numbered but indicated with dotted lines between outer face sheet 130B and inner face sheet 128B.

Although the use of a foam core 132A/132B is discussed herein, it is to be understood that this essentially represents only one type of core material that can be utilized in a composite building panel (or structural panel). For example, other types of core material may be substituted for the foam core, such as a conventional honeycomb core structure.

Indicated at 192 is what is known in the art as a reveal, or, in the context of a building wall assembly, an indentation that is recessed into the wall assembly. In the present example, reveal 192 is defined between upper panel 114A and lower panel 114B. Generally, a reveal provides an enhanced visual effect on the outer side of a building wall assembly. Conventionally, reveals tend to be shallow, that is, of limited dimension in a direction defined orthogonally between the outer side of the wall assembly and the inner side. (For the present discussion, "depth" or "thickness" may be defined as that dimension oriented horizontally with respect to FIG. 4, while the dimension perpendicular thereto in FIG. 4, oriented vertically, may be defined as "width".)

In contrast, the present invention, in accordance with at least one presently preferred embodiment, broadly contemplates a reveal 192 that is considerably deeper than the norm. Surprisingly, it has been found that such a reveal provides an enhanced visual effect from the outside and, further, that it is easier to fabricate and install corner panels, and connections therebetween, having such a reveal. Additionally, any repairs that are located within the reveal are essentially hidden to passersby because of the depth of the reveal. Such repairs might include, but are not limited to, those that are undertaken when forming a corner joint, particularly, when, subsequent to cutting a V-notch in the panels to be used at a corner and bending the panels, plate or sheet material is provided at the seam where the V-notch was cut.

The depth of the reveal is indicated as the dimension x in FIG. 4. In accordance with a presently preferred embodiment of the present invention, this dimension will be no less than about 0.75 inch. In the illustrated example, dimension x is 1.25 inches, while the depth of both panels 114A and 114B is 2 inches. Surprising and unexpected advantages, as described above, have been encountered with deep reveals. Further, the present invention broadly contemplates reveals having dimensions that are even greater than 1.25 inches, as deep as is practicable in view of the physical requirements inherent to the wall assembly in question.

A sloped shelf 196 may preferably be provided within reveal 192. In accordance with at least one presently preferred embodiment of the present invention, the shelf 196 will be sloped at about three degrees. Conventionally, slopes of five degrees have been encountered.

An independent concept is indicated with the arrow designated by reference numeral 194. Particularly, arrow 194 illustrates the presence of one or more apertures through face sheet 130B, and at the bottom of gutter 145, through which liquid present in the gutter 145 may exit the gutter 145. One or more such apertures may preferably be distributed throughout the length (i.e. in a direction perpendicular to the plane of the drawing) of gutter 145. For example, one such aperture may be present about every 12 inches along the length of gutter 145. Preferably, the location and distribution of the aperture(s) will be chosen in such a manner as to drain liquid from the gutter, and also to equalize pressure within the gutter, most efficiently and effectively.

Figure 4A:
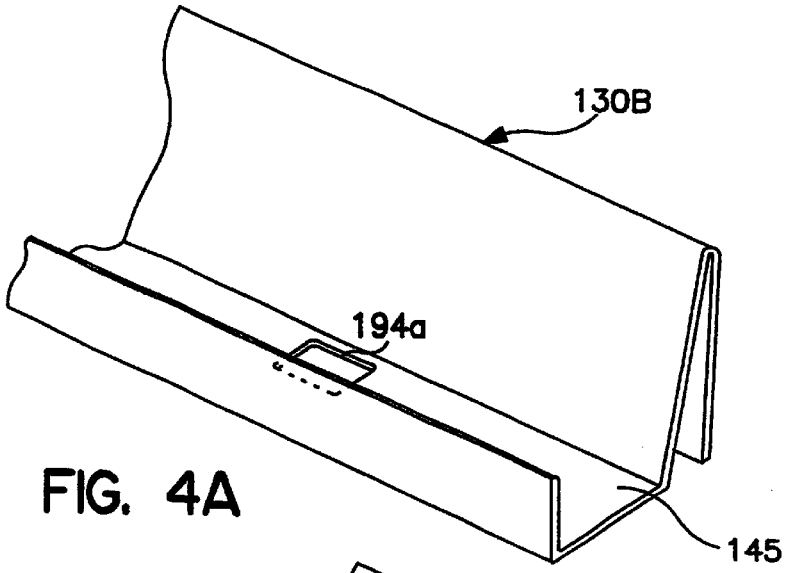
FIG. 4*a* is a perspective, isolated view of a face sheet and gutter having one type of aperture disposed therein.
Figure 4B:
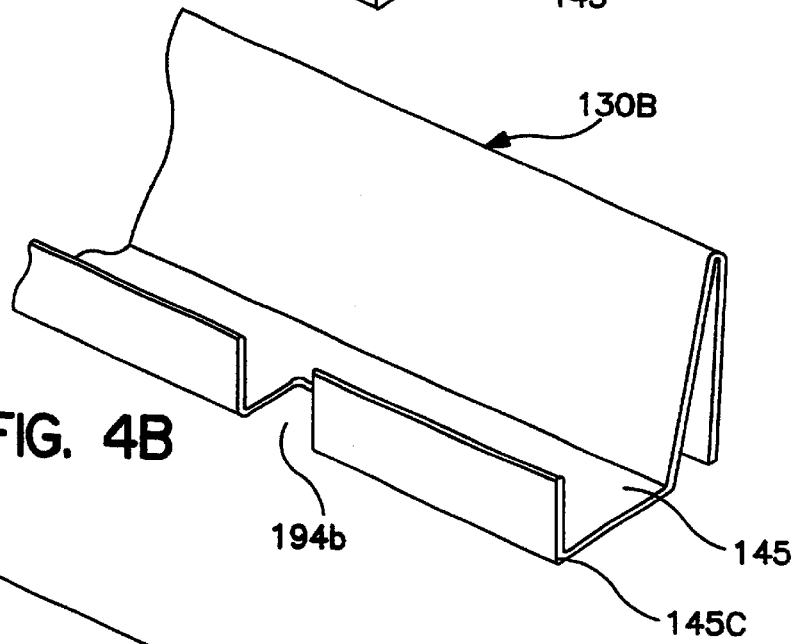
FIG. 4*b* is substantially the same view as FIG. 4*a* but illustrating another type of aperture.
Figure 4C:
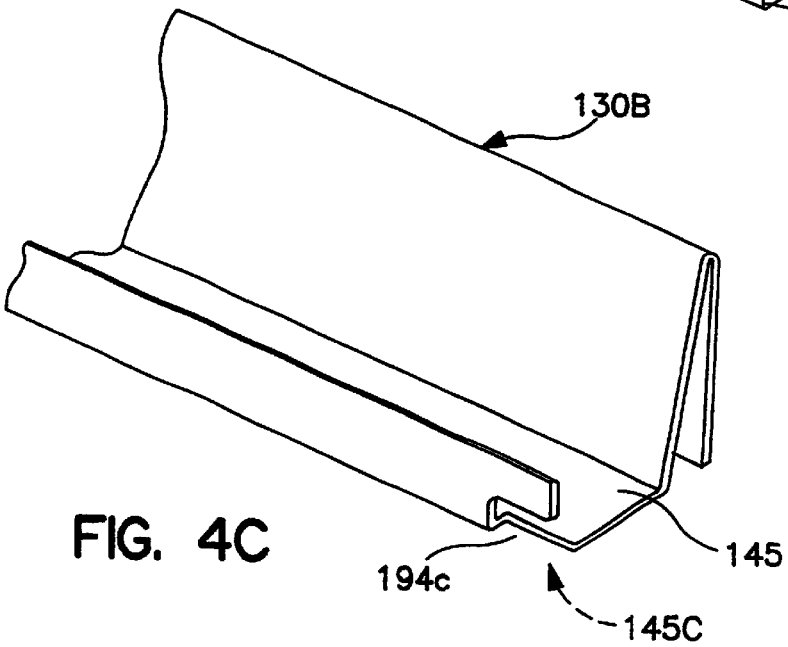
FIG. 4*c* is substantially the same view as FIG. 4*a* but illustrating yet another type of aperture.

FIGS. 4*a*–4*c* illustrate, in isolated perspective view, a lower panel face sheet 130B, where this forms gutter 145, with different types of apertures that might be utilized in accordance with at least one presently preferred embodiment of the present invention.

FIG. 4*a* illustrates a bottom aperture 194*a*, which may be disposed in a lowermost or bottom portion of gutter 145.

FIG. 4*b*, on the other hand, illustrates an "edge notch" aperture 194*b*, which may be disposed in a portion of gutter 145 that is away from an end corner 145C of gutter 145.

FIG. 4*c* illustrates a "corner notch" aperture 194*c* that is disposed right at an end corner 145C of gutter 145. In this case, it should be understood that the end corner 145C may essentially be located at a corresponding end of the corresponding panel. If the gutter 145 does not feed into a vertical discharge channel (see the patent to Brow et al.) and instead terminates, at the illustrated end, at a gasket or other solid member that does not permit the onward horizontal flow of liquid beyond the gutter end, it will be appreciated that the liquid will then be discharged out through the corner notch 145*c*.

The types of apertures illustrated in FIGS. 4*a*–4*c* are provided as examples only, and are not intended in any way to limit the scope of the present invention. In each case, the aperture or apertures in question is/are disposed intermediately with respect to the opposing ends of the gutter, in contrast or in addition to arrangements in which the gutters open at their ends to vertical discharge channels, as described in the patent to Brow et al.

The present invention also contemplates, in accordance with at least one presently preferred embodiment, an arrangement in which the one or more apertures being used are not disposed to direct liquid flow from what are essentially lowermost portions of gutter 145, as illustrated in FIGS. 4*a*–4*c*, but are disposed at somewhat higher points of the gutter wall that faces outwardly. In this case, liquid will accumulate within the gutter and will discharge from the aperture(s) once the liquid level within the gutter matches the level of the aperture(s). Although it is generally recognized that such accumulation of liquid in a gutter is undesirable, it will be appreciated that the present invention contemplates such an arrangement particularly in conjunction with the use of vertical discharge channels, as discussed in the patent to Brow et al. In this instance, it will be appreciated that the aperture(s) presently contemplated can serve the purpose of overflow drainage, in the event that the normal drainage through the gutter end(s) to the vertical discharge channels is backed up or inhibited for any reason.

It will be appreciated that such a means of egress of liquid from gutter 145 can be used alone or in conjunction with an arrangement such as that described in the aforementioned patent to Brow et al., in which, at junctures between horizontally adjacent building panels, there are vertical discharge channels into which an internally disposed gutter opens.

In accordance with at least one presently preferred embodiment of the present invention, a deep reveal 192 may be utilized in conjunction with the aperture(s) 194 just described. In such an eventuality, and as illustrated in FIG. 4, the reveal 192 may preferably be defined partly by a sloped shelf 196. Such a sloped shelf will preferably assist considerably in diverting any liquid emanating from apertures 194 out of the reveal 192. It will be appreciated that the sloped shelf 196 also serves to divert away liquid from external sources, such as rain that is blown into the reveal 192 by the wind that enters reveal 192 by washing down the external face of the building wall assembly. The shallow slope discussed heretofore, preferably of about three degrees, has been found to be quite adequate for affording drainage away from the reveal 192.

Preferably, reveal 192 will have a predetermined width y. A manner of customizing this width will be discussed further below. In the embodiment illustrated in FIG. 4, if it is assumed that the overall depth of the panel structure is about 2 inches, then dimension y, the width of the reveal 192, is illustrated as being ½ inch, which is recognized throughout the industry as a standard width.

Figure 4D:
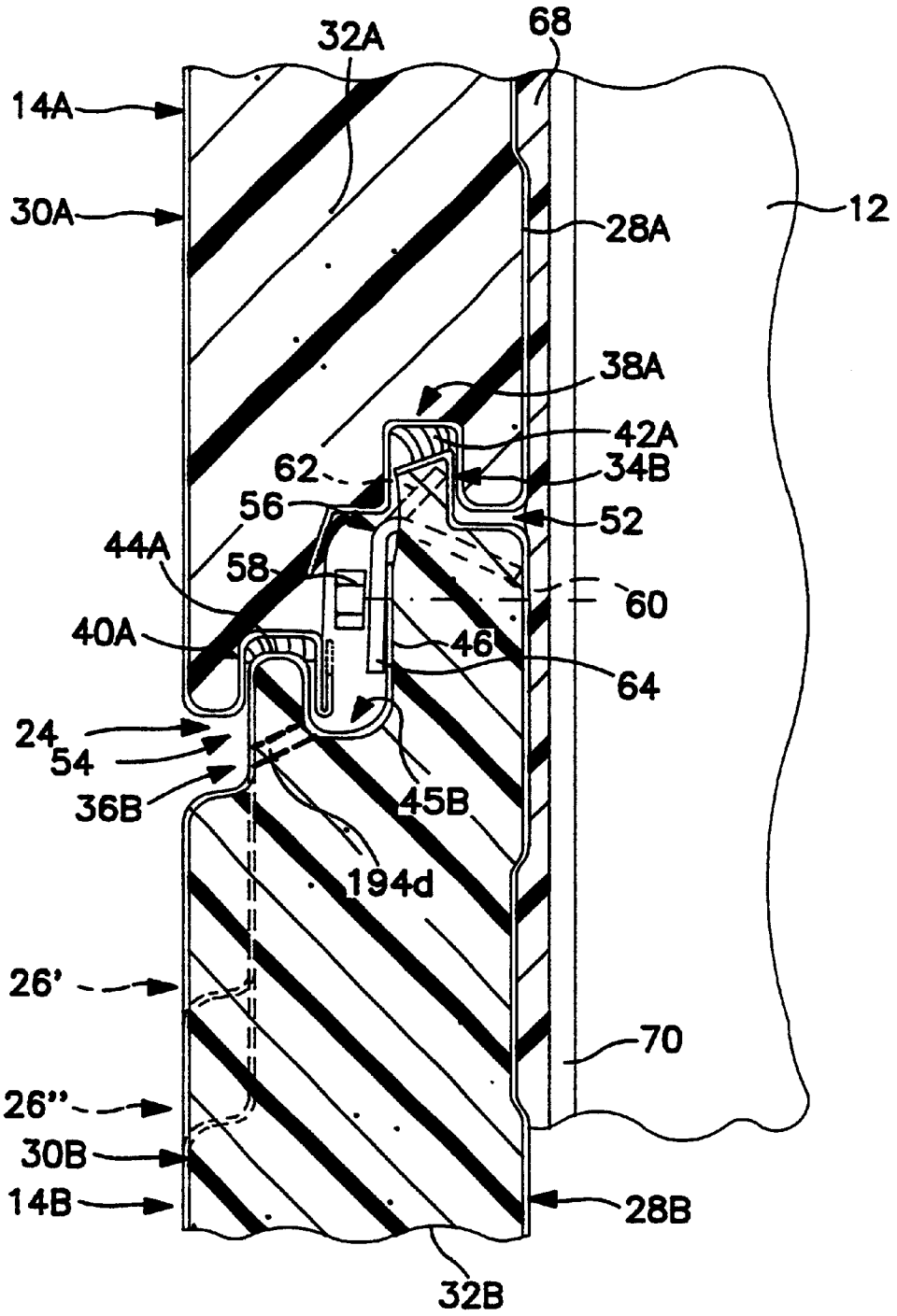
FIG. 4*d* is substantially the same view of FIG. 3, but illustrating an aperture arrangement through the structural foam core.

As shown in FIG. 4D, it is conceivable, within the scope of the present invention, to utilize one or more apertures 194*d* in conjunction with a panel system such as that described and illustrated heretofore with respect to FIG. 3. As shown, aperture(s) 194*d* may proceed from gutter means 45B, through foam core 32B, and may exit through an opening in face sheet 30B. It will thus be appreciated that the present invention contemplates not only the use of one or more apertures in conjunction with a deep reveal that permits immediate egress of liquid from an internal gutter arrangement to the outside, but also in conjunction with a structural panel containing a foam or other core, such as the panel 14B shown in FIG. 4B, wherein aperture(s) 194*d* may actually tunnel through the foam or other core in a suitable manner in order to facilitate the egress of liquid from an internal gutter arrangement. Again, such an arrangement of aperture(s) could be provided instead of or in addition to the types of vertical discharge channels that are described in the patent to Brow et al.

Figure 5:
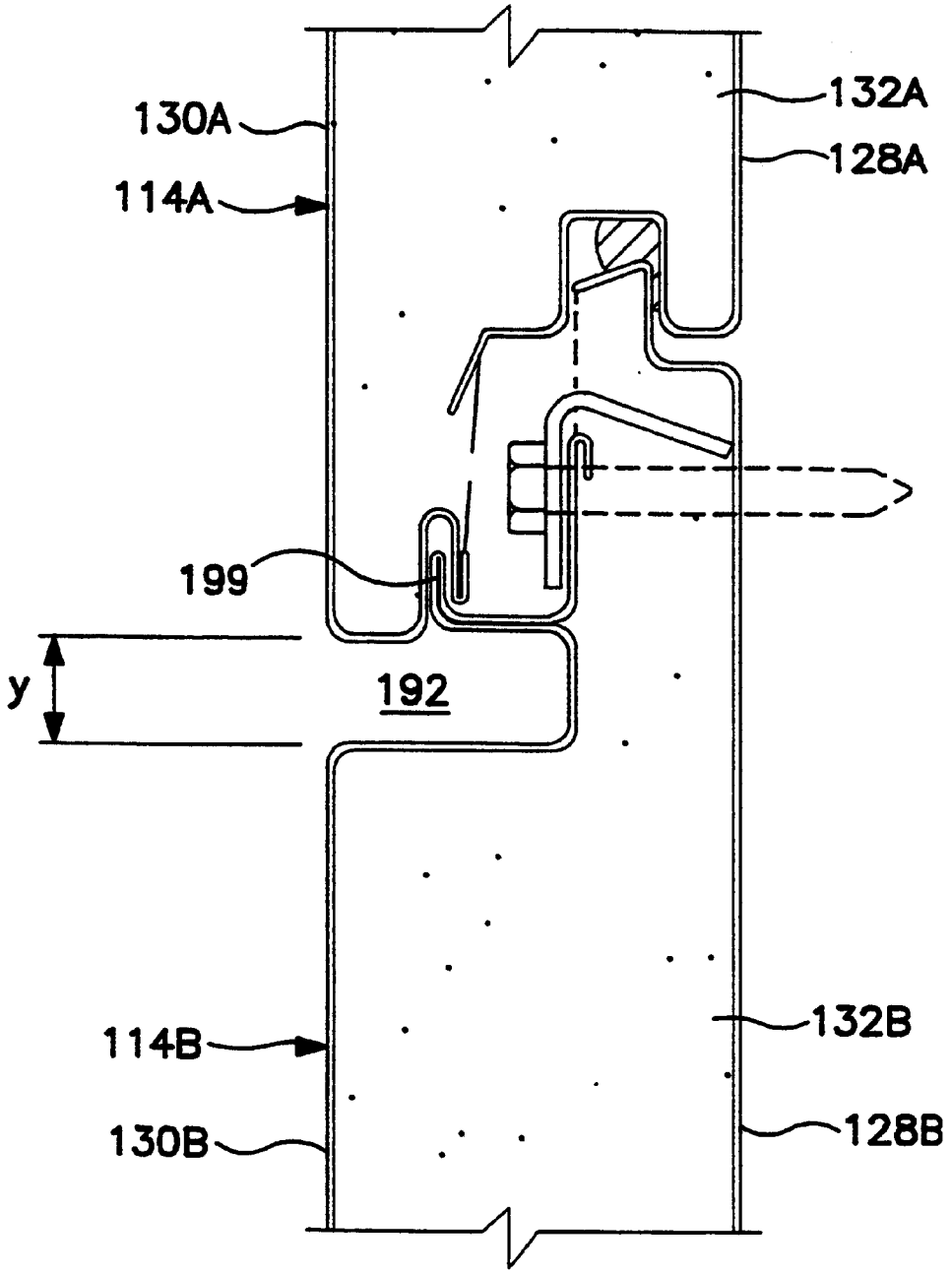
FIG. 5 is substantially the same view as FIG. 4, but illustrating a "mid-hook" face sheet attachment.

Indicated at 198 is an edge-hook, or terminal portion, of outer face sheet 130B. It has been found that forming a face sheet in such a manner provides for a sounder connection with upper panel 114A than might otherwise be encountered. However, in an alternative embodiment, FIG. 5 illustrates a "mid-hook" 199 in place of the edge-hook 198 of FIG. 4. Mid-hook 199, in FIG. 5, is preferably formed as a crimped, intermediate portion of face sheet 130B, configured for extending upwardly into a corresponding pocket in upper panel 114A.

Figure 6:
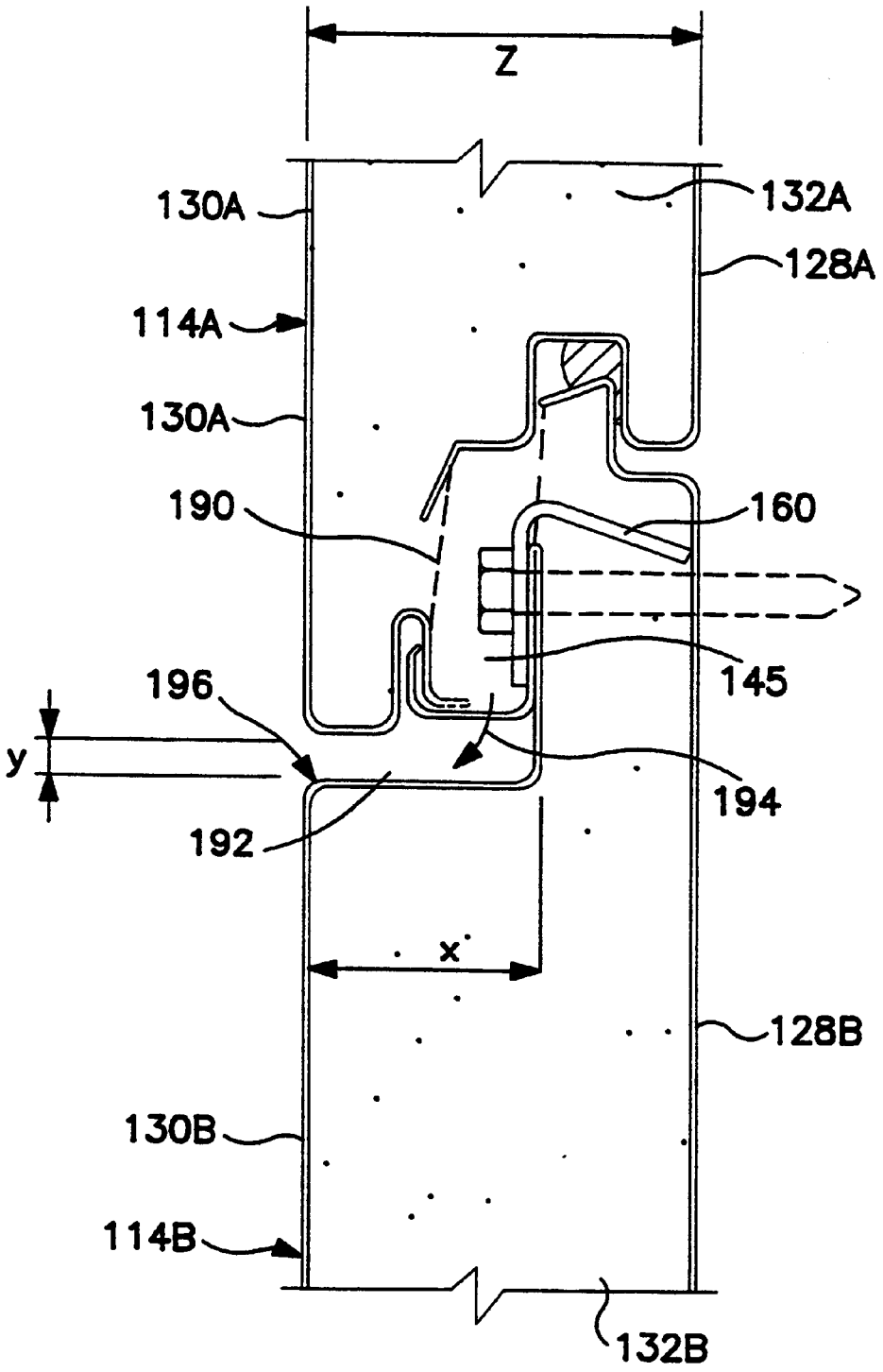
FIG. 6 is substantially the same view as FIG. 4, but illustrating a narrower reveal width.
Figure 7:
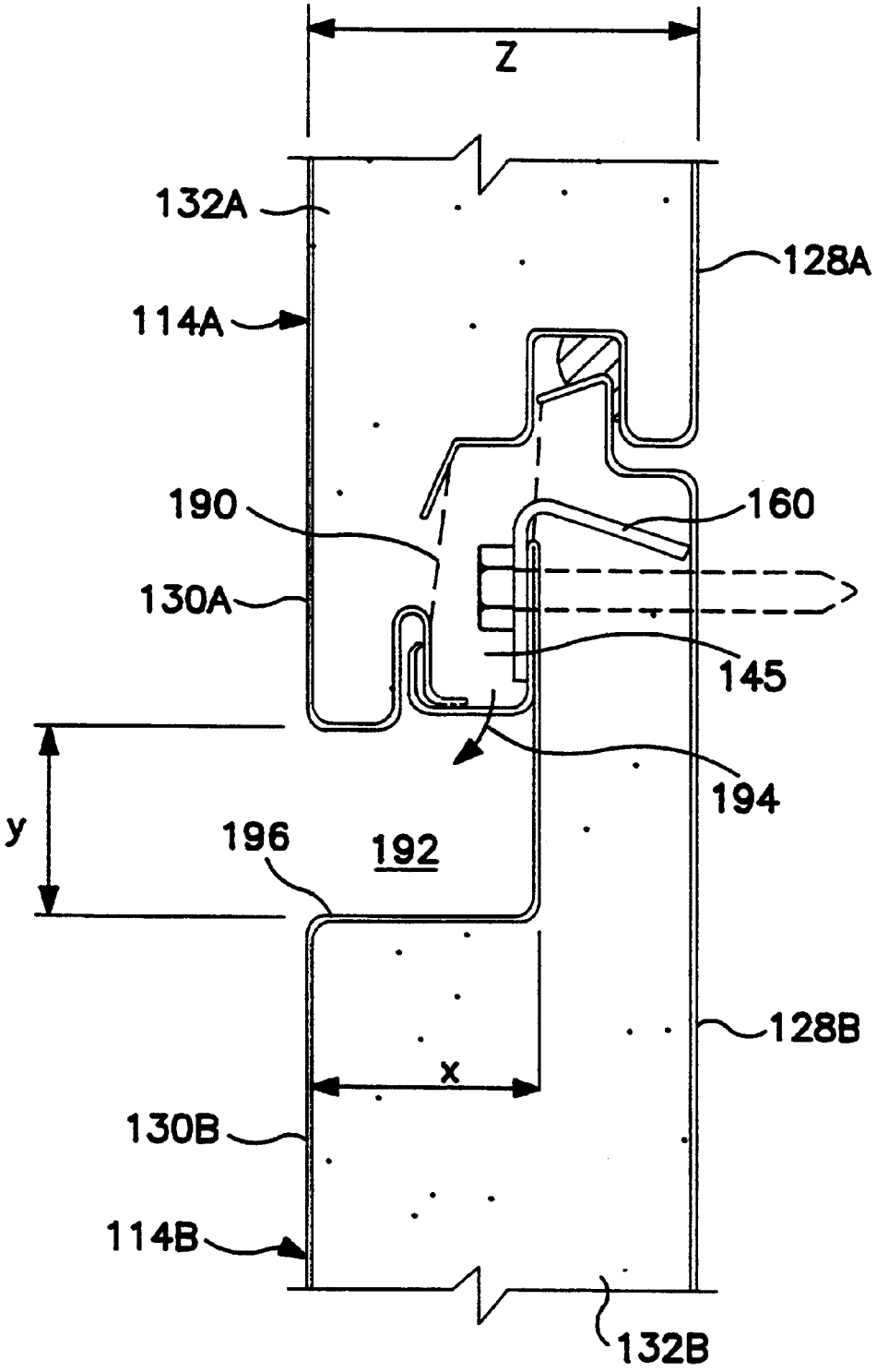
FIG. 7 is substantially the same view as FIGS. 4 and 6, but showing a greater reveal width.

FIGS. 6 and 7 represent substantially similar views as FIG. 4, but illustrate, respectively, a narrower reveal width and a greater reveal width. Particularly, if it is assumed that the overall depth of the panel structure is about 2 inches in each case, then dimension y, the width of the reveal 192, is illustrated as being ⅛ inch in FIG. 6 and 2 inches in FIG. 7. As will be described further below, the present invention contemplates, in accordance with at least one presently preferred embodiment, the possibility of customizing dimension y in a unique manner.

Figure 8:
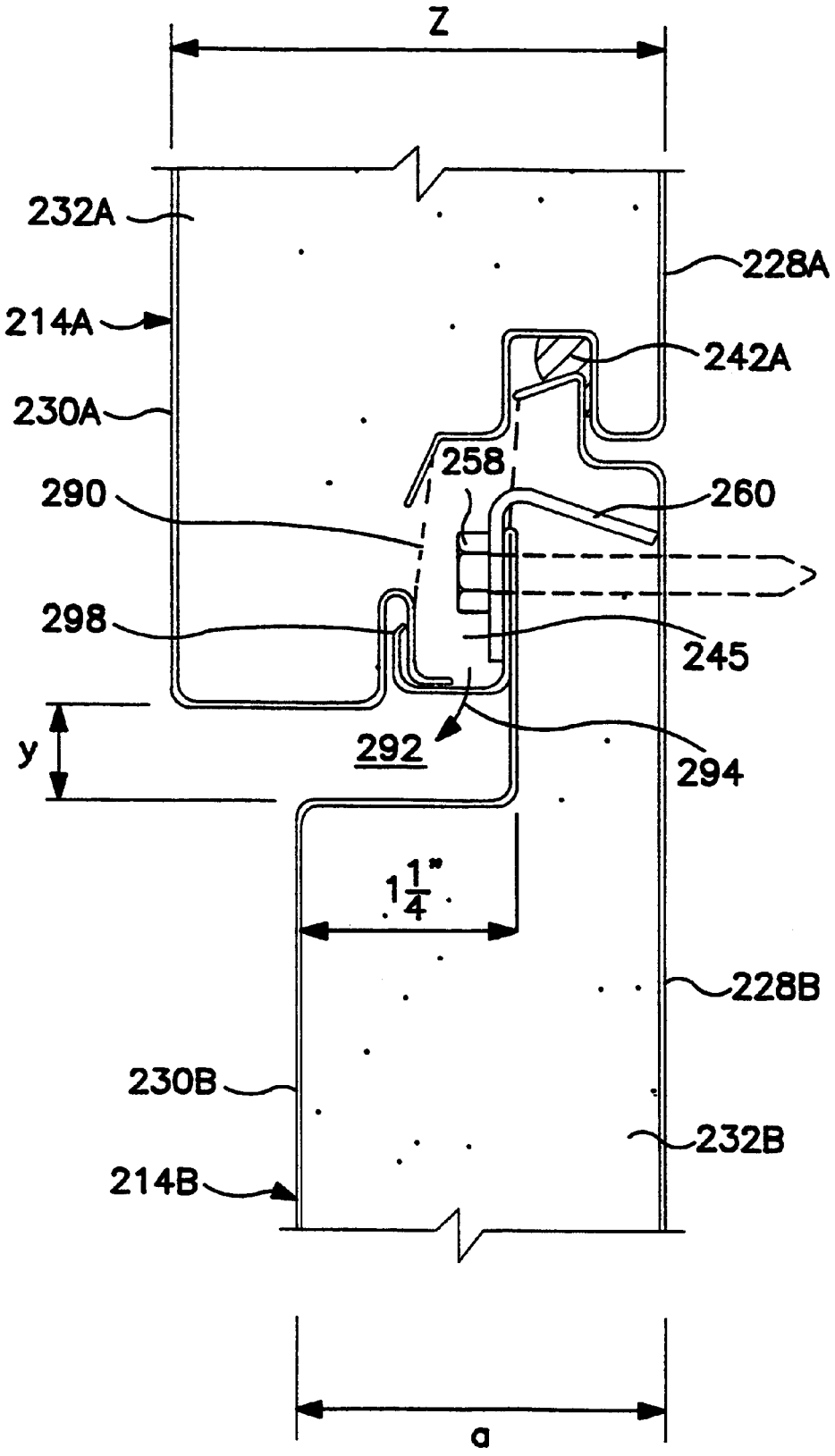
FIG. 8 is substantially the same view as FIG. 4, but illustrating an upper panel of greater depth than the lower panel.
Figure 9:
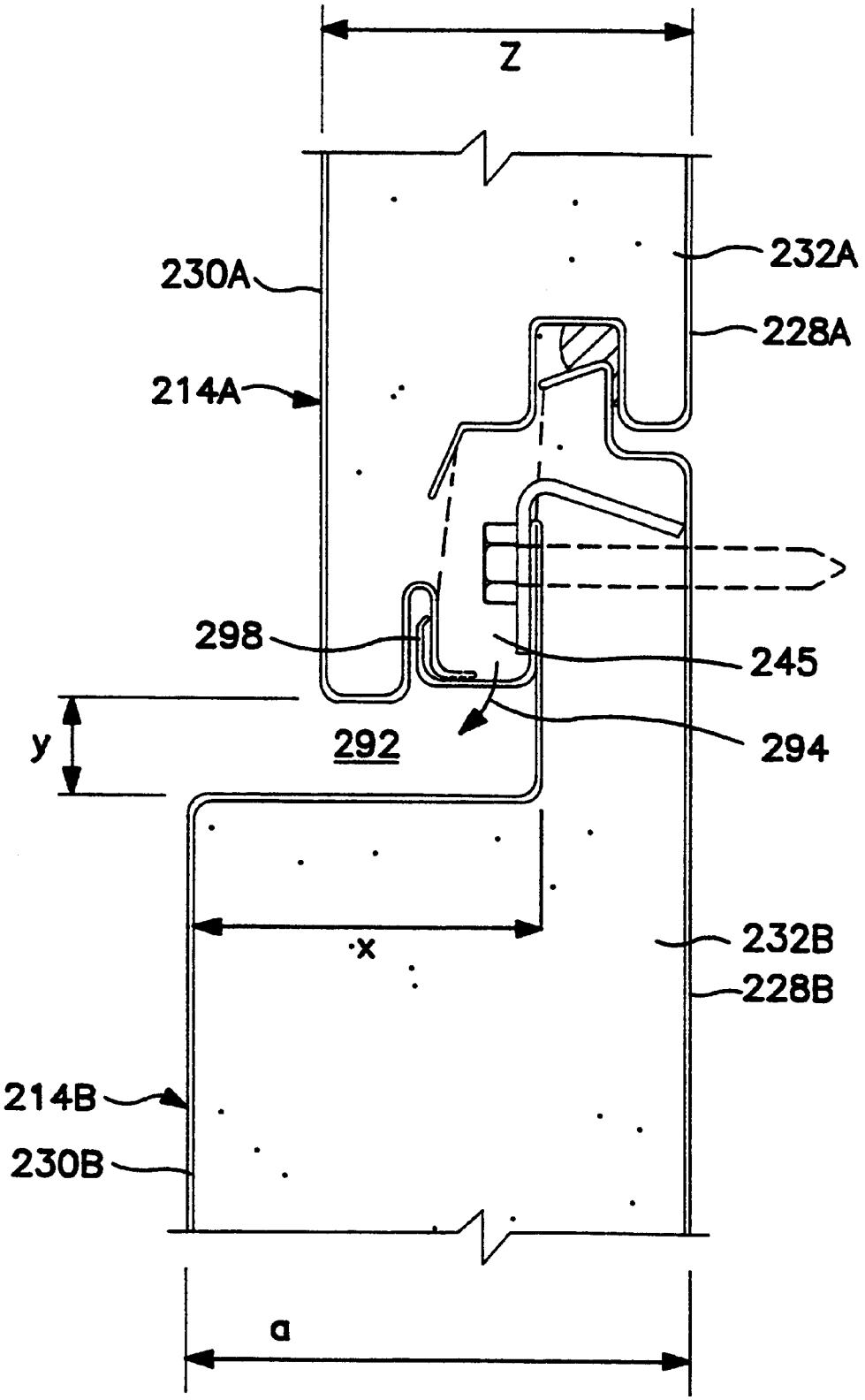
FIG. 9 is substantially the same view as FIG. 4, but illustrating a lower panel of greater depth than the upper panel.
Figure 10:
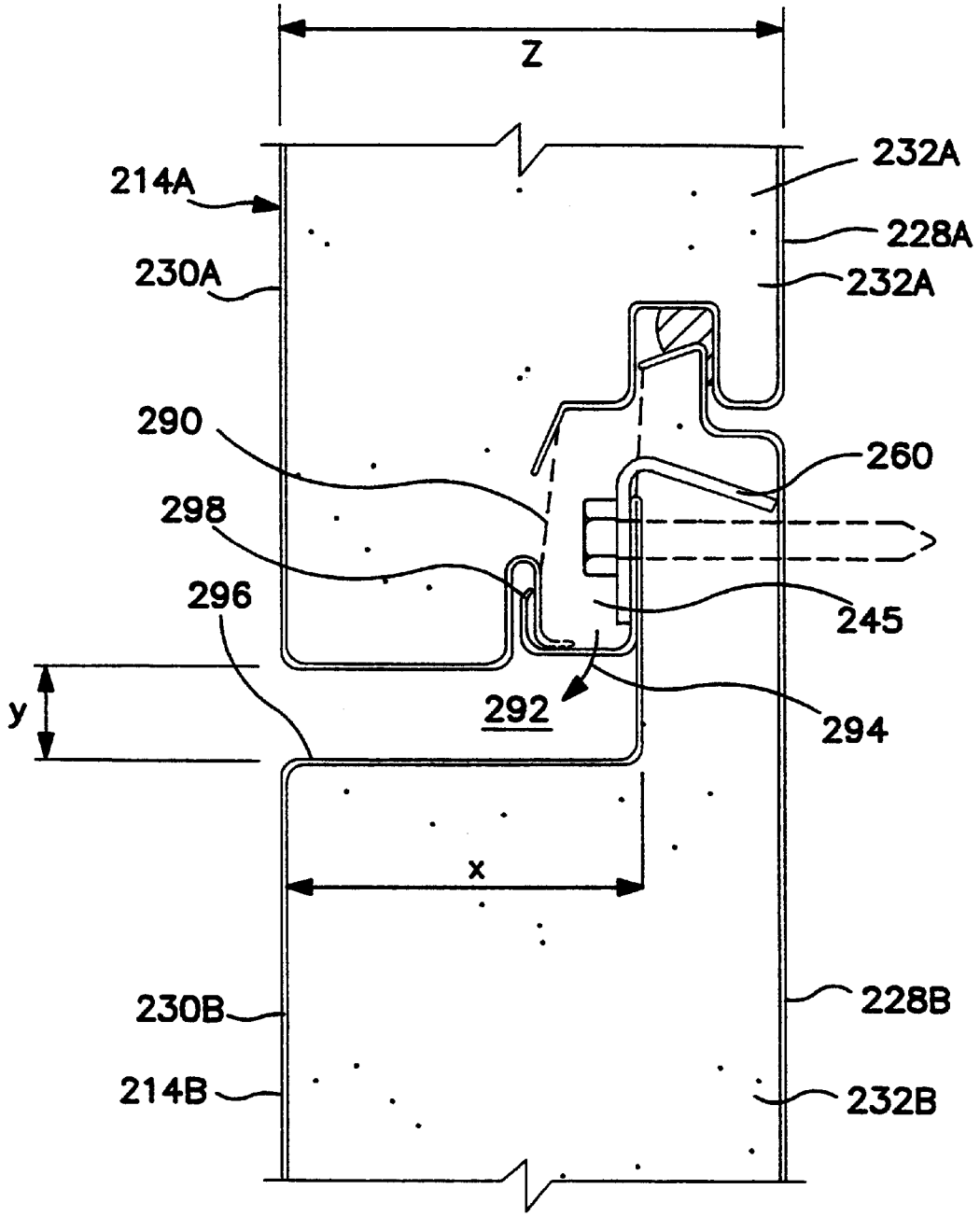
FIG. 10 is substantially the same view as FIG. 4, but illustrating upper and lower panels of greater depth than those shown in FIG. 4.

The disclosure now turns to a discussion of a particularly versatile application afforded by at least one presently preferred embodiment of the present invention. In FIGS. 8–10, components that are substantially analogous to components in FIGS. 1–3 have been so indicated by advancing the reference numerals by 200.

FIG. 8 illustrates an example in which upper panel 214A has a notably greater overall depth (or thickness) z than the overall depth (or thickness) a of lower panel 214B. In the illustrated example, dimension a is equal to about 2 inches while dimension z is equal to about 2.75 inches. As shown, dimension x is still equal to about 1.25 inches.

On the other hand, FIG. 9 illustrates an example in which upper panel 214A has a notably smaller overall depth z than the overall depth a of lower panel 214B. In the illustrated example, dimension a is equal to about 2.75 inches while dimension z is equal to about 2 inches. In this case, dimension x, or the greatest depth of the reveal, is equal to about 2 inches. The proportion represented by the greatest reveal depth x with respect to the depth a of the lower panel has thus increased to about 8/11, or about 0.727.

Finally, FIG. 10 illustrates an example in which upper panel 214A has the same, larger overall depth z as the overall depth a of lower panel 214B. In the illustrated example, dimension a is equal to about 2.75 inches while dimension z is also equal to about 2.75 inches. Dimension x, or the greatest depth of the reveal, is again equal to about 2 inches, and the proportion represented by the greatest reveal depth x with respect to the depth a of the lower panel is again 8/11, or 0.727. Accordingly, FIGS. 8–10 illustrate a measure of versatility, in assembling wall assemblies, afforded by at least one presently preferred embodiment of the present invention. In each case, it is possible to maintain a significantly deep reveal, with the attendant advantages described heretofore.

Figure 11:
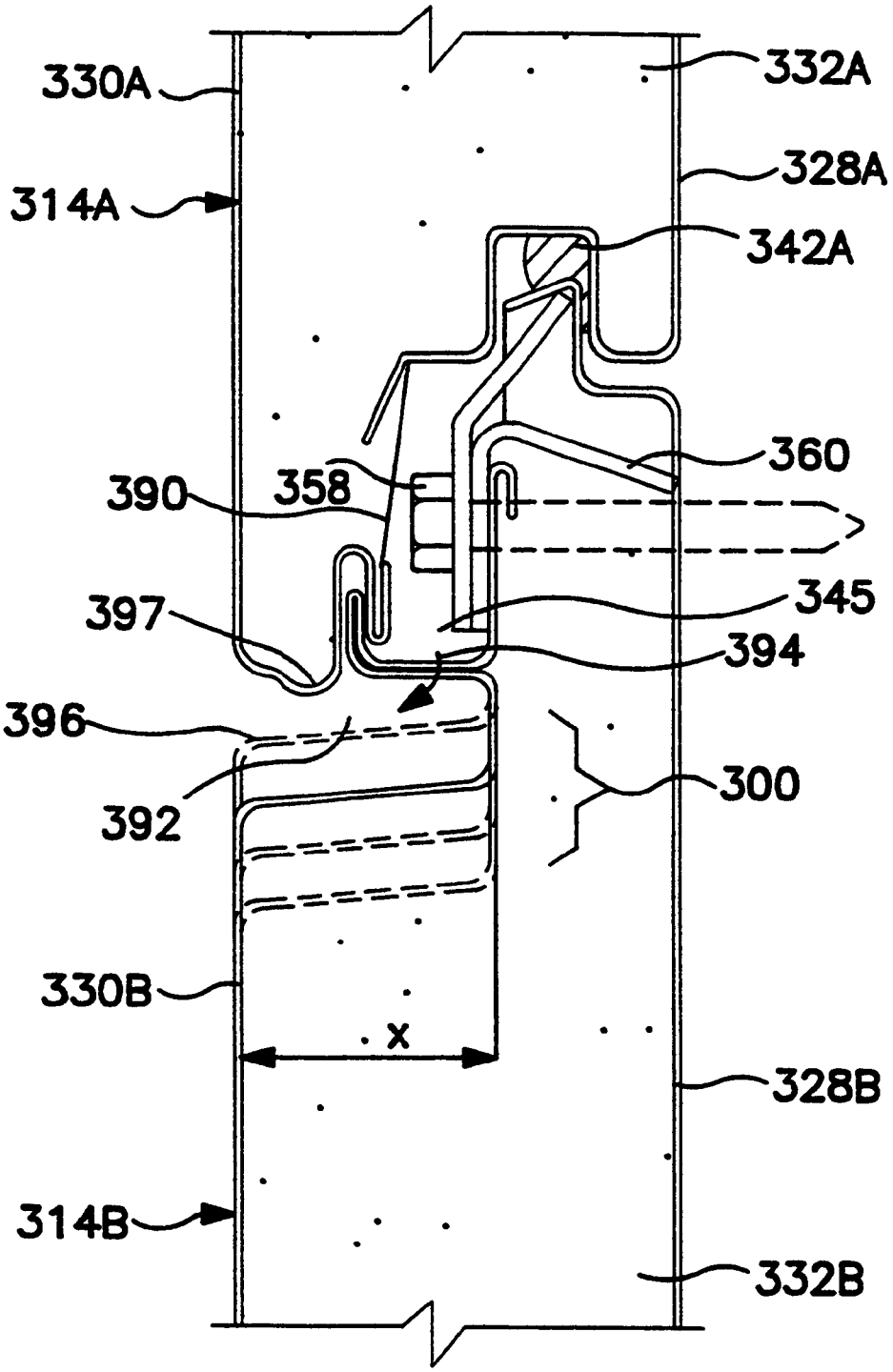
FIG. 11 is substantially the same view as FIG. 4, but illustrating a reveal of customizably varying width.

Furthermore, it will be appreciated that essentially the same type of connection scheme has been preserved in each of the configurations illustrated in FIGS. 8–10. As shown, an upper bent portion 298 of lower outer face sheet 230B may preferably be so configured and designed as to mate adequately with a corresponding recessed portion of upper outer face sheet 230A. In this case, the bent portion 298 is in the form of a "J-hook", but could also be configured as a "mid-hook" as shown in FIG. 11. In either case, the present invention broadly contemplates, in accordance with at least one presently preferred embodiment, the facilitated interchangeable assembly of various upper panels 214A and lower panels 214B of differing depths, whereas conventionally this might have been difficult and cumbersome in view of differing and incompatible connection schemes.

In accordance with an embodiment of the invention, the "J-hook" 298 shown in FIGS. 8–10, and elsewhere, could be realized in two discrete pieces, as opposed to the single piece shown. Thus, one smaller piece would be constituted only by the J-shaped portion. In this manner, the tight 180-degree bend illustrated in FIGS. 8–10 would be eliminated. Such a realization might be desirable if the bulk of the outer face sheet is formed from a heavy-gauge material, and would thus be unsuitable for the type of intricate bending shown in FIGS. 8–10. In such an instance, the separate J-hook 298A could be formed from a lighter gauge material, such as stainless steel or aluminum. Of course, a separate J-hook might be desirable for other reasons, as determined by the dictates of the user.

It will further be appreciated that the configurations described and illustrated with respect to FIGS. 8–10 can be utilized in the context of vertically-oriented panels, as opposed to horizontally-oriented panels. In the case of vertically-oriented panels, then, it is to be understood that FIGS. 8–10 can be interpreted as plan, rather than elevational, views and that the connection between panels 214A and 214B can be construed as a vertical joint, rather than a horizontal joint. The inclusion of aperture(s) 294 does not necessarily detract from the use of panels 214A and 214B in a vertical orientation, as they could conceivably assist in serving the purpose of pressure equalization, especially if internal gutter 245 does not lead to orthogonally oriented external channels at either of its ends.

The disclosure now turns to a discussion of customizing the reveal width in accordance with at least one presently preferred embodiment of the present invention. In FIG. 11, components that are substantially analogous to components in to FIGS. 1–3 have been so indicated by advancing the reference numerals by 300.

FIG. 11 illustrates an arrangement in which the width (i.e., the dimension y shown in earlier drawings) of reveal 392 can be customized. Thus, indicated at 300, via dotted and solid lines, is a representation of drainage shelf 396 in different positions as a function of the width of reveal 392. Also shown is an optional drip edge 396.

In accordance with at least one presently preferred embodiment of the present invention, suitable tooling may be utilized to quickly and efficiently change over an appropriate forming apparatus, such as a roll-forming apparatus, from one configuration, in which one given reveal width is produced, to another configuration, in which another given reveal width is produced. It is believed that this type of versatile customization would be of great benefit to manufacturers who would wish to cater, at short notice, to the divergent requests of one or more customers as regards the width of a reveal. In accordance with at least one presently preferred embodiment of the present invention, reveal widths from about ⅛" to greater than about 2" (such us up to about 6") are possible, such as in increments of about ¼".

Figure 11A:
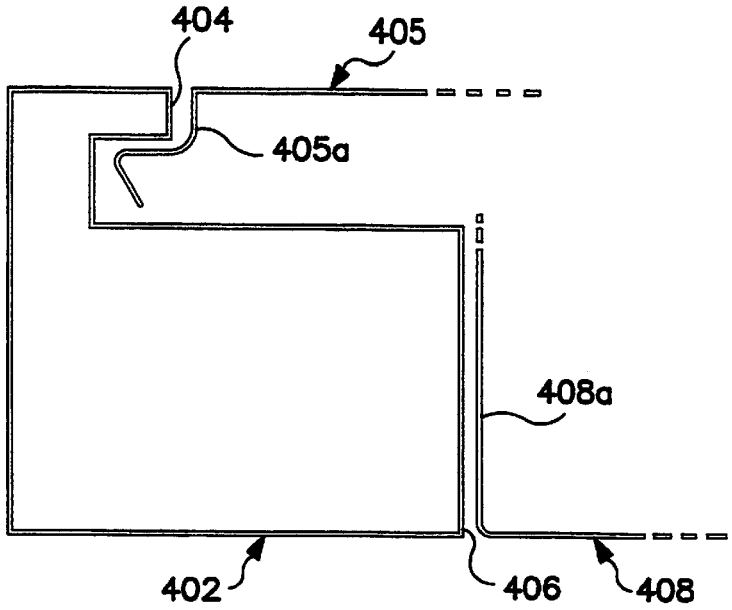
FIG. 11A illustrates a conventional registration block arrangement used in the formation of building panels.

FIG. 11A illustrates a conventional registration block (or side rail) arrangement typically utilized subsequent to the roll-forming of face sheets for building panels. Typically, registration blocks are used to hold face sheets in an accurate positional relationship prior to, and during, the application of an insulative material, such as foam, between the face sheets. As shown, block 402 may include, among other things, a first end face 404 and a second end face 406. As shown, first end face 404 is configured for engaging with that portion 405*a* of an inner face sheet 405 (e.g., similar to sheet 328B shown in FIG. 11) that has been bent at one end of inner face sheet 328B. On the other hand, second end face 406 is configured for engaging with that portion 408*a* of an outer face sheet 408 (e.g., similar to sheet 330B shown in FIG. 11) that forms the lower part of a reveal (such as reveal 392 shown in FIG. 11).

Per convention, the engagement of a registration block with face sheets takes place once the face sheets have already been roll-formed, or formed in some other manner, for the purpose of positioning and aligning the face sheets with respect to one another in preparation for the injection or insertion of the desired core material between the face sheets. In the case of a structural foam core, the foam is typically injected into the cavity between the two face sheets (once registered via the registration block), and the registration block typically assists in preventing the foam from inadvertently leaking from this cavity during the injection process.

It will thus be appreciated that registration block 402, in connection with the conventional example shown in FIG.

11A, provides registration at two significant points, namely the aforementioned "bend" portion 405*a* of an inner face sheet 405 and the lower "reveal" portion 408*a* of an outer face sheet 408. A disadvantage that has often been encountered with the type of registration block illustrated in FIG. 11A is that essentially only one predetermined and fixed reveal width can be accommodated. Particularly, since that portion of the outer face sheet defining the lower limit of the reveal is used in registration, then only one reveal width, as defined by the formation of the same portion of the outer face sheet, can essentially only be introduced to the corresponding registration block. In the industry, it is well-known that such registration blocks are expensive items to purchase and install. Thus, the capacity for customizable formation with different reveal widths is severely hampered, as a different registration block is essentially required for each different reveal width that is introduced.

Figure 11B:
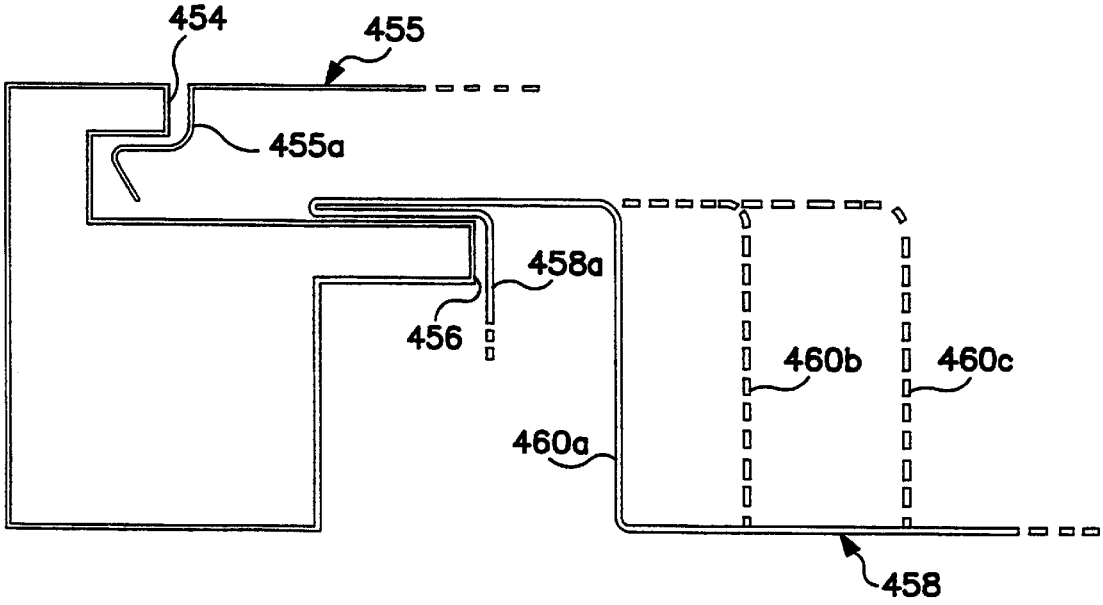
FIG. 11B illustrates a registration block arrangement in accordance with an embodiment of the present invention.

In contrast, FIG. 11B illustrates a registration arrangement, according to at least one presently preferred embodiment of the present invention, that is configured to accept outer face sheets that result in different reveal widths.

As shown in FIG. 11B a registration block 452 may include a first face 454 and a second face 456. Similarly to the arrangement described and illustrated with respect to FIG. 11A, the first face 454 will preferably be configured as to engage with that portion 455*a* of an inner face sheet 455 (e.g., similar to sheet 328B shown in FIG. 11) that has been bent at one end of inner face sheet 455. In contrast to the arrangement shown in FIG. 11A, however, the second end face 456 is preferably configured for engaging not with a portion of an outer face sheet 458 (e.g., similar to sheet 330B shown in FIG. 11) that forms the lower part of a reveal (such as reveal 392 shown in FIG. 11), but with a portion 458*a* of an outer face sheet 458 that forms a portion of the top of the reveal. It will thus be appreciated that registration block 452 provides registration at two significant points that are different from the significant points encountered by the registration block 402 shown in FIG. 11A. In accordance with the embodiment shown in FIG. 11B, the significant points are the aforementioned "bend" portion 455*a* of an inner face sheet 455 and the "upper" reveal portion 458*a* of an outer face sheet 458.

Accordingly, it will be appreciated that, by registering the "upper" reveal portion 458*a* of an outer face sheet 458, a great degree of latitude is afforded in introducing to the registration block 402 inner face sheets 455 that have "lower" reveal portions that were formed with varying dimensions.

It will also be appreciated that the inventive arrangement shown in FIG. 11B can lend itself admirably to a forming apparatus in which a roll-forming unit and a foam injection unit (or a unit otherwise dedicated to the introduction of an insulative material) are included in the same assembly line, so that sheets that have been roll-formed can progress automatically to a registration block for the subsequent introduction of insulative material. In such an integrated assembly line, by virtue of the use of a registration arrangement such as that shown in FIG. 11B, it will be possible to change reveal widths quickly and efficiently, perhaps even on the fly.

Conventionally, a roll-forming unit and foam-injection (or other insulation introduction) unit are separate entities. It is believed that integration of the units to date has been hindered by the inherent difficulties in changing each apparatus between different configurations for use with different reveal widths. However, it is believed that the inventive arrangement illustrated in FIG. 11B lends itself easily to an integrated assembly line, in that the registration block arrangement will rarely, if ever, need to be changed, even if significantly different reveal widths are produced in the associated roll-forming unit.

It will further be appreciated that the inventive arrangement shown in FIG. 11B, with its registration points at regions 455*a* and 458*a* of face sheets 455 and 458, respectively, also aids considerably in preventing the inadvertent escape of foam from the space formed between the face sheets 455 and 458, and in fact has been found to represent a marked improvement as such in comparison with conventional arrangements.

The disclosure now turns to a discussion of the customizable assembly of different panels in accordance with at least one presently preferred embodiment of the present invention. In FIGS. 12–15, any components that might be substantially analogous to components in FIGS. 1–3 have not necessarily been advanced by a multiple of 100 as has been done in FIGS. 4–11.

Figure 12:
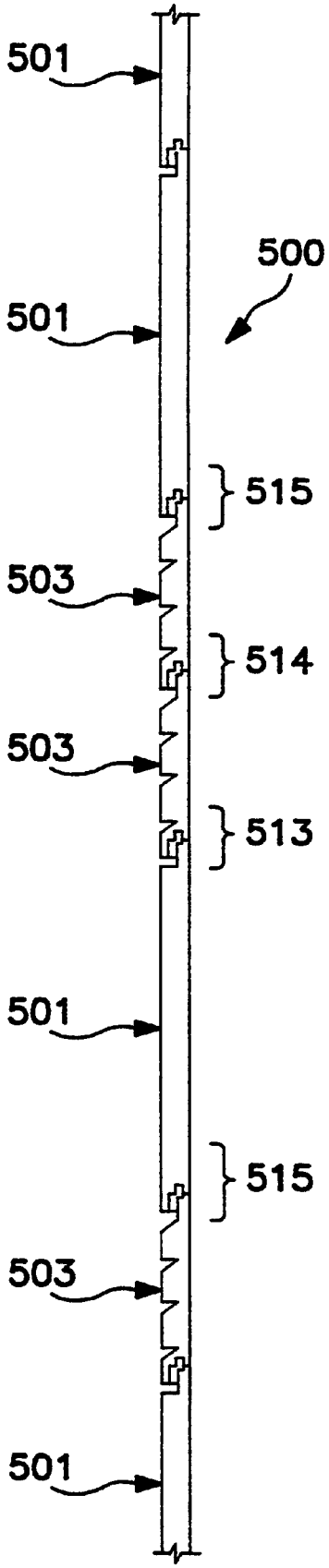
FIG. 12 illustrates a building wall portion that includes both foam panels and profiled sheet metal panels.

FIG. 12 illustrates a general wall assembly 500 having composite structural panels, such as foam panels, 501 along with decorative profile panels 503. Usually, decorative profile panels 503 are formed from sheet metal and may contain therewithin some form of insulation and, as shown, may also contain decorative or otherwise aesthetically significant features, such as the types of indentations shown in FIG. 12.

Figure 13:
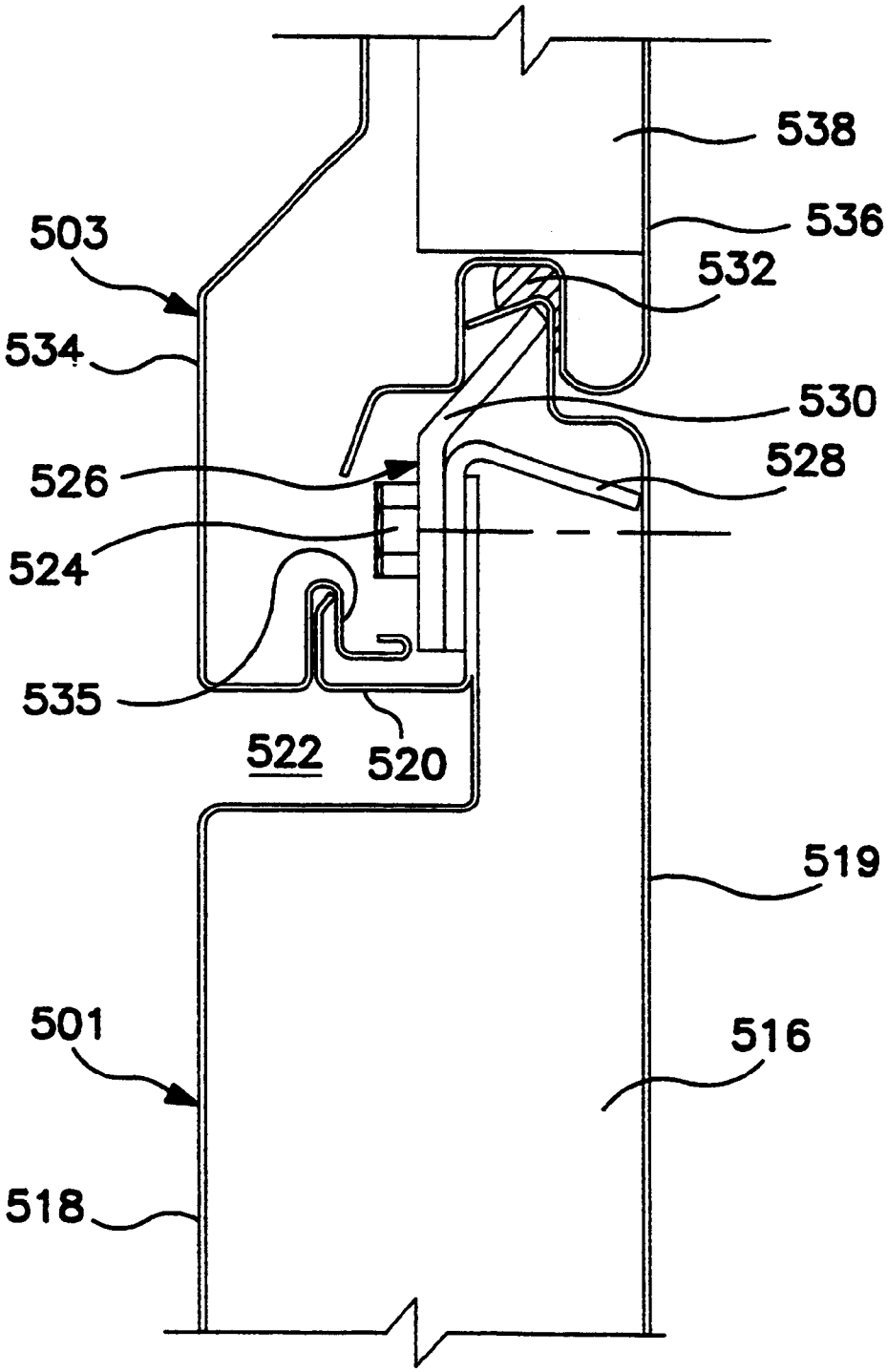
FIG. 13 is a close-up cross-sectional view taken from FIG. 12, and illustrating a connection between a profiled panel and a foam panel.

Indicated at 513 is a first connection scheme, to be described and illustrated in more detail with respect to FIG. 13. Likewise, 514 indicates a second connection scheme, corresponding to FIG. 14, whilst 515 indicates a third connection scheme, corresponding to FIG. 15. In accordance with at least one presently preferred embodiment of the present invention, these three types of connection schemes are of such a nature that they afford the easy and customizable interchanging and intermingling of structural panels 501 and profile panels 503.

In FIG. 13, a profile panel 503 is connected atop a structural panel 501. In known manner, structural panel 501 includes a structural foam core that is flanked by outer face sheet (or simply "face sheet") 518 and inner face sheet(or "inner" or "liner sheet") 519, respectively. Indicated at 520 is a "J-hook" extension of outer face sheet 518. A reveal 522, as shown, may be defined between the upper, profile panel 503 and the lower, structural panel 501. A suitable attachment mechanism 524, such as a bolt, may be used to hold firmly a clip 526. This clip 526 may include legs 528 and 530, the former extending into the structural foam core 516 and the latter extending upwardly into a nook or bend formed in inner face sheet 519.

In known manner, a suitable sealant or sealing arrangement 532 may be provided between panels 503 and 501. Upper profile panel 503 itself preferably contains outer and inner facing (or face) sheets 534 and 536, respectively. At the lower end of outer face sheet 534, there is preferably a bent terminal portion 535 that serves as a receptacle for the "J-hook" portion 520 of outer face sheet 518 of lower structural panel 501. In known manner, a sheet of insulation 538 may preferably be provided within profile panel 503.

Figure 14:
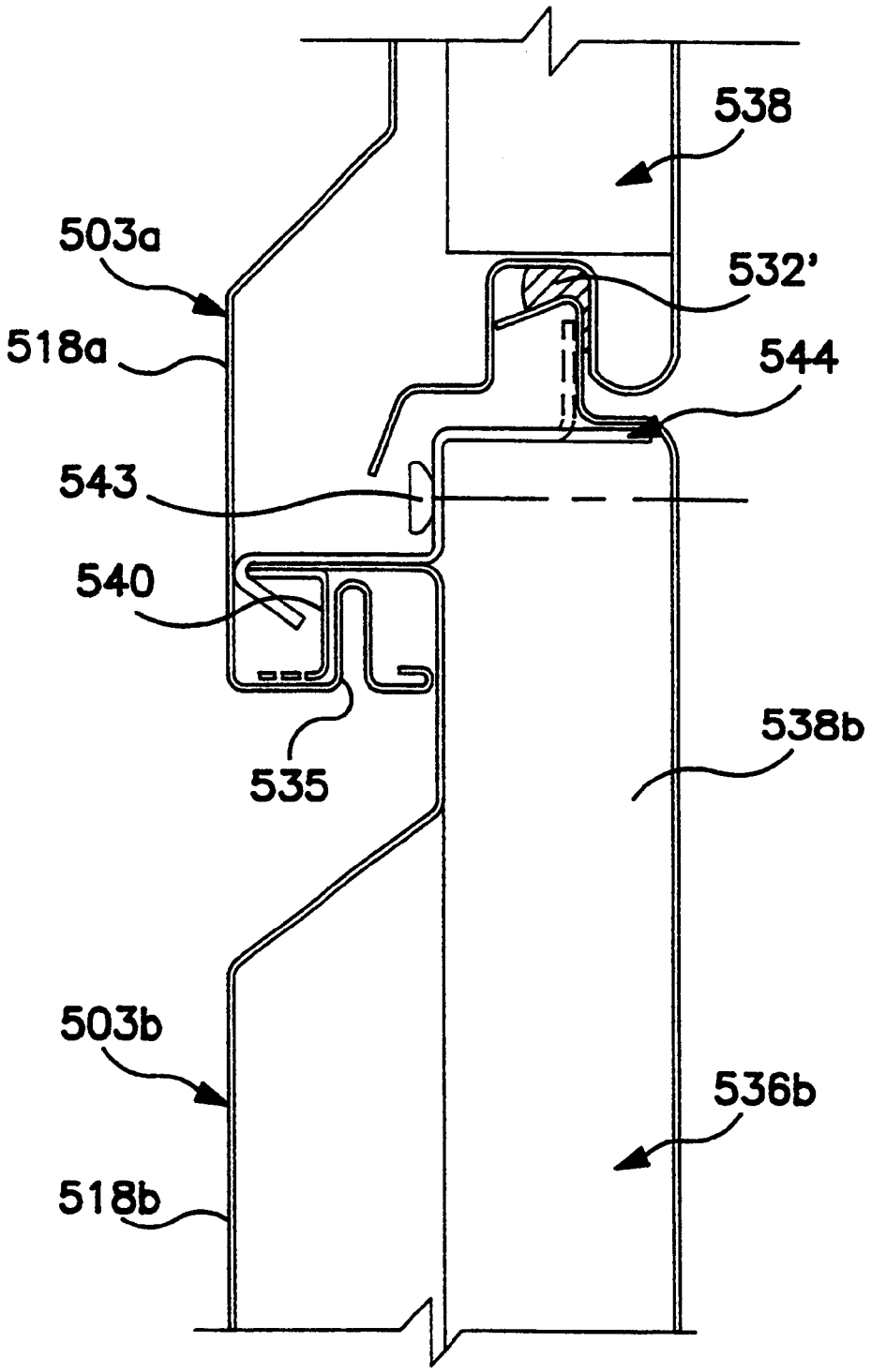
FIG. 14 is a close-up cross-sectional view taken from FIG. 12, and illustrating a connection between two profiled panels.

In FIG. 14, a first profile panel 503*a* is connected atop a second profile panel 503*b*. Similar reference numerals, indicating similar components, have been retained from FIG. 13, with the addition of "a" or "b" to indicate components in panels 503*a* and 503*b*, respectively.

As shown, the outer face sheet 518*b* of lower panel 503*b* may include an intricately bent end portion 540 configured for mating with the lower bent portion 535 of the outer face sheet 518*a* of upper panel 503*a*. A clip 544, attached to insulation sheet 538*b* with a suitable attachment device, such as a bolt, 543, may preferably be configured for accommodating part of bent end portion 540. Also, it may preferably have a splayed upper end, as shown, to accommodate a bent upper portion of inner face sheet 536*b* of lower panel 503*b*. Again, a suitable sealant or sealing arrangement 532' is preferably provided.

Figure 15:
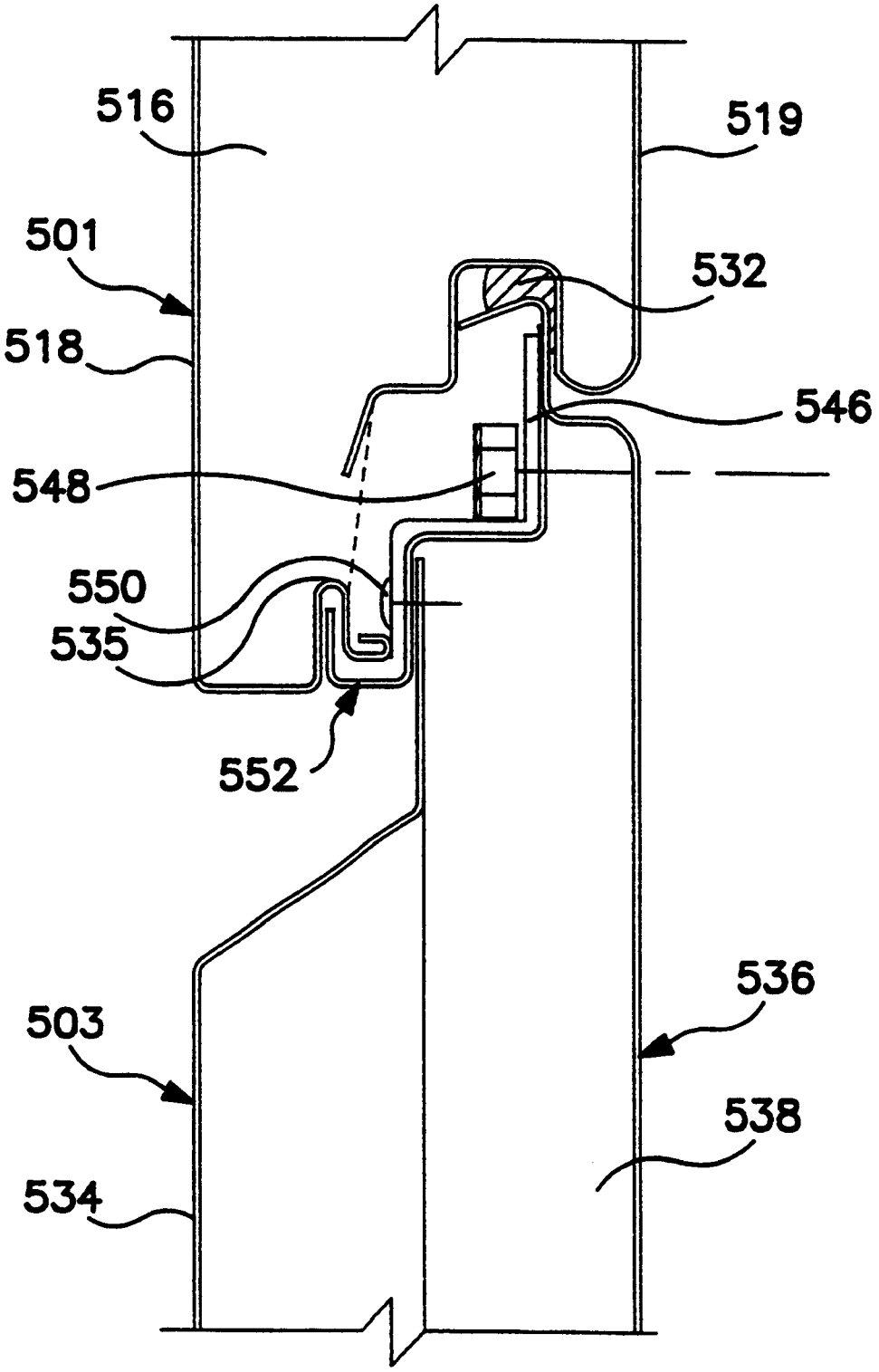
FIG. 15 is a close-up cross-sectional view taken from FIG. 12, and illustrating a connection between two foam panels.

In FIG. 15, a structural panel 501 is connected atop a profile panel 503. Similar reference numerals, indicating similar components, have been retained from FIG. 13.

As shown, a clip 546 may preferably be utilized with attachment devices (such as bolts) 548 and 550 that extend into and/or through insulation sheet 538. An adapter clip 552, extending from the attachment point of attachment device 550 with clip 546, may preferably be configured to extend into the recess created by lower bent portion 535 of structural panel 501.

From a review of FIGS. 13–15, it can now be appreciated that an efficient, customizable and interchangeable system of interconnection has been afforded. Particularly, very similar schemes of interconnection may be utilized between different pairs of panels (i.e., structural-profile; profile-profile; profile-structural). In accordance with at least one presently preferred embodiment of the present invention, the connectable ends of each of the panels will preferably be configured so as to easily and interchangeably accommodate either a profile panel or a structural panel, at most with only minor modification.

Conventionally, profile panels have tended to be formed in rather singular manner at their connectable ends. It will thus be appreciated that, in accordance with at least one presently preferred embodiment of the present invention, such panels will preferably undergo at their ends such artificial formation as to be fully integrable with either another profile panel or a structural panel.

It may thus be appreciated that, in a broad aspect of the invention, a profile panel is adaptively configured so as to be able to mate with a structural building panel in such a manner as to mimic essentially the same physical characteristics, and associated advantages, normally found in a connection between two structural building panels. Although one specific manner realizing such a feature has been described and illustrated with respect to FIGS. 13–15, it is to be understood that the present invention broadly contemplates essentially any specific manner of realizing the connections between the illustrated panels, with the proviso that similar performance characteristics will be achieved as in the case of two interconnected structural panels.

In a particularly advantageous refinement of this embodiment of the present invention, the inner face sheets in question, variously indicated at 519, 536, 536*a* and 536*b*, will preferably be realized in such a manner as to result in the establishment of a consistent barrier, with consistent sealing, against vapor pressure, air infiltration and water infiltration. Whereas it has generally been conventional to eliminate liner sheets (536, 536*a*, 536*b*) from profile panels, the present invention contemplates the inclusion of such sheets in a manner that essentially mimics the manner in which they are realized in structural panels. Thus, it will be appreciated from a review of FIGS. 13, 14 and 15 that the upper and lower panels in each case, be they structural or profile panels, exhibit similar physical and operational characteristics. For example, the liner sheets of the upper and lower panels will exhibit coplanarity as in an interconnection between structural panels (see, for example, FIG. 4).

Advantages are also apparent in the context of sealing. Particularly, a factory-installed seal (e.g., such as indicated at 532 and 532') is normally supplemented, in the context of adjacent structural panels, by a field-installed seal. The field-installed seal normally abuts the liner sheets on the building side of the wall assembly, and will normally migrate into cavities between the upper and lower panels so as to "meet" the factory-installed seal. Such a sealing arrangement provides very favorable protection against air, vapor and water infiltration.

Because, in accordance with at least one presently preferred embodiment of the present invention, a profile panel will mimic several characteristics of a structural panel, a similar advantage will be encountered here. Particularly, material from a field-installed seal will preferably migrate into a cavity 533 (as shown in each of FIGS. 13–15) between upper and lower panels, resulting in the same advantages as just described.

Between the arrangements illustrated in FIGS. 13–15, it will also be appreciated that the different types of clip connections used, that extend either into a foam core 516 or insulation sheet 538/538*b*, are easily interchangeable.

Yet another advantage can be found in that essentially the same type of formation tooling, such as roll-form tooling, can be utilized to form the face or liner sheets of structural panels and profile panels alike.

If not otherwise stated herein, it is to be understood that any and all of the building panels, and interconnections, illustrated and described herein may be utilized either in a horizontal configuration or in a vertical configuration. Particularly, it is recognized that the structures and components described and illustrated herein in connection with at least one presently preferred embodiment of the present invention are applicable not only to the context of horizontal panels connected by horizontal joints but also to the context of vertical panels connected by vertical joints.

Provided herebelow is a brief recapitulation of some features according to at least one presently preferred embodiment of the present invention.

A deep reveal offers several unique features. First, the depth of reveal allows it to perform as a pressure equalized pocket, possibly in addition to an internal pressure equalized pocket (such as may be afforded by an internally disposed gutter), while allowing venting of the panel, such as along the entire length of the panel. The depth also creates a reveal with a bolder aesthetic appearance, which is known to be preferred by some designers. Also, the deep reveal can be more easily fabricated into corner panels than shallow reveals. Bent or folded corner panels are the most common applications in this regard.

Essentially the same geometry as in U.S. Pat. No. 5,749,282 (Brow et al.) can be used. This allows the interface with the same extrusions used for panel trim, reveals, and window systems.

Vertical joints created at the ends of horizontal panels can be treated in several ways. First, they can be filled with opened extruded gasketry, which will allow water to drain from the enclosed joint pocket to the vertical joint. Second, a solid closed-cell foam gasket can be used to keep water out of the vertical joint.

The method of joint design as presented will allow the engagement of multiple panel thickness. For example, a thick panel can be engaged to a thin panel and vice versa. This is accomplished by having a common top edge of panel regardless of thickness. (See FIGS. 8–10).

The inventive joint can be used in either a horizontal or vertical orientation. This will be helpful in allowing fewer changeovers.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. The scope of the invention is defined by the following claims rather than the foregoing description. All changes which come within the meaning and range of equivalency of the claims are to be embraced within their scope.

What is claimed is:

1. A horizontal joint between upper and lower building panels, wherein:

said lower panel comprises at least one connector comprising at least one of: at least one male connector and at least one female connector;

said upper panel comprises at least one connector comprising at least one of: at least one male connector and at least one female connector;

at least one connector of said upper panel being connected with at least one connector of said lower panel to form an outer joint;

means for diverting liquid;

said liquid diverting means comprising a gutter;

said gutter having first and second ends;

said liquid diverting means further comprising at least one aperture disposed between said first and second ends of said gutter;

wherein said at least one aperture is adapted to provide fluid communication with the ambient atmosphere and provide pressure equalization for said gutter.

2. The horizontal joint according to claim 1, wherein said at least one aperture permits the substantially immediate vertical egress of liquid from said gutter.

3. The horizontal joint according to claim 1, wherein:

said outer joint comprises an inner seal; and said at least one aperture is disposed outwardly of said inner seal.

4. The horizontal joint according to claim 1, wherein said at least one aperture comprises at least two apertures.

5. The horizontal joint according to claim 4, wherein said at least two apertures are distributed substantially evenly over the length of said gutter.

6. The horizontal joint according to claim 1, wherein said at least one aperture is disposed at vertically lowermost portions of said gutter.

7. The horizontal joint according to claim 1, further comprising an opening disposed at one end of said gutter, said opening comprising means for directing fluid to a vertical discharge channel.

8. The horizontal joint according to claim 1, further comprising a reveal having a depth that is no less than about 0.75 inch.

9. The horizontal joint according to claim 8, wherein said reveal comprises a sloped drain shelf.

10. The horizontal joint according to claim 9, wherein said sloped drain shelf has a slope of about three degrees.

11. The horizontal joint according to claim 1, wherein said upper and lower panels comprise at least one composite building panel.

12. The horizontal joint according to claim 11, wherein said at least one composite building panel comprises at least one composite foam building panel.

13. The horizontal joint according to claim 1, wherein said lower panel comprises two male connectors and said upper panel comprises two female connectors.

14. A building wall comprising:

an upper building panel and a lower building panel;

said lower panel comprises at least one connector comprising at least one of: at least one male connector and at least one female connector;

said upper panel comprises at least one connector comprising at least one of: at least one male connector and at least one female connector;

at least one connector of said upper panel being connected with at least one connector of said lower panel to form an outer joint;

means for diverting liquid;

said liquid diverting means comprising a gutter;

said gutter having first and second ends;

said liquid diverting means further comprising at least one aperture disposed between said first and second ends of said gutter;

wherein said at least one aperture is adapted to provide fluid communication with the ambient atmosphere and provide pressure equalization for said gutter.

15. The building wall according to claim 14, wherein said at least one aperture permits the substantially immediate vertical egress of liquid from said gutter.

16. The building wall according to claim 14, wherein:

said outer joint comprises an inner seal; and said at least one aperture is disposed outwardly of said inner seal.

17. The building wall according to claim 14, wherein said at least one aperture comprises at least two apertures.

18. The building wall according to claim 17, wherein said at least two apertures are distributed substantially evenly over the length of said gutter.

19. The building wall according to claim 14, wherein said at least one aperture is disposed at vertically lowermost portions of said gutter.

20. The building wall according to claim 14, further comprising an opening disposed at one end of said gutter, said opening comprising means for directing fluid to a vertical discharge channel.

21. The building wall according to claim 14, further comprising a reveal having a depth that is no less than about ⅝ of the overall depth of at least one of said upper panel and said lower panel.

22. The building wall according to claim 21, wherein said reveal comprises a sloped drain shelf.

23. The building wall according to claim 22, wherein said sloped drain shelf has a slope of about three degrees.

24. The building wall according to claim 14, wherein said upper and lower panels comprise at least one composite building panel.

25. The building wall according to claim 24, wherein said at least one composite building panel comprises at least one composite foam building panel.

26. The building wall according to claim 14, wherein said lower panel comprises two male connectors and said upper panel comprises two female connectors.

* * * * *